US005870842A

United States Patent [19]

Ogden et al.

[11] Patent Number: 5,870,842

[45] Date of Patent: Feb. 16, 1999

[54] APPARATUS FOR CONTROLLING AN ANIMATED FIGURE

[75] Inventors: Andrew M. Ogden, Pasadena; Marshall M. Monroe, La Canada; David F. Barnett, Simi Valley, all of Calif.

[73] Assignee: Disney Enterprises, Inc., Burbank, Calif.

[21] Appl. No.: 641,908

[22] Filed: May 2, 1996

[51] Int. Cl.[6] ..... G09F 19/08

[52] U.S. Cl. ..... 40/411; 40/414; 446/362

[58] Field of Search ..... 40/411, 414, 418, 40/419, 420; 446/327, 361, 362

[56] References Cited

U.S. PATENT DOCUMENTS

| | | | |
|---|---|---|---|
| 2,047,377 | 7/1936 | Liwschutz | 40/420 X |
| 2,629,966 | 3/1953 | Russ | 40/414 |
| 3,391,485 | 7/1968 | Fosser | 446/362 X |
| 3,672,092 | 6/1972 | Tepper et al. . | |
| 3,767,901 | 10/1973 | Black et al. . | |
| 4,995,610 | 2/1991 | Paoletti . | |
| 5,021,878 | 6/1991 | Lang . | |
| 5,142,803 | 9/1992 | Lang . | |
| 5,182,557 | 1/1993 | Lang . | |
| 5,198,893 | 3/1993 | Lang . | |
| 5,270,480 | 12/1993 | Hikawa . | |
| 5,289,273 | 2/1994 | Lang . | |
| 5,318,471 | 6/1994 | Glovier . | |
| 5,393,058 | 2/1995 | Rowland et al. . | |
| 5,394,766 | 3/1995 | Johnson et al. . | |

*Primary Examiner*—Kenneth J. Dorner
*Assistant Examiner*—Andrea Chop
*Attorney, Agent, or Firm*—Pretty, Schroeder & Poplawski

[57] ABSTRACT

An animated figure method and apparatus including an animated figure having moveable elements and a base unit for supporting the animated figure. The apparatus of the present invention includes multiple control cables, a first end of each control cable connects to a cable driver assembly or cable driver mounted on the base unit and a second end of each control cable attaches to a corresponding animated figure moveable element or assembly. The cable drivers that are attached to the base unit drive the control cables, and propel the animated figure's moveable elements. The present invention achieves detailed control of many animated figure functions using intricate control cable branching which may require many bends in the control cable. In addition, a walk mechanism provides both horizontal and vertical movement of the animated figure's feet to achieve simulated stepping movements in a very realistic manner. Further, the walk mechanism in combination with a motion base allows the animated figure of the preferred embodiment to move about a set, such as a stage, by dancing, walking, running or other movements, thereby increasing the overall animation presentation significantly.

16 Claims, 11 Drawing Sheets

338
334
294
250
256
256
272
258
255
310
252
270
309
510
288
312
291
268
290
268
254
251
285
276
282
286
284
283
280
50
253
50
266
23
14
506
44

FIG. 3
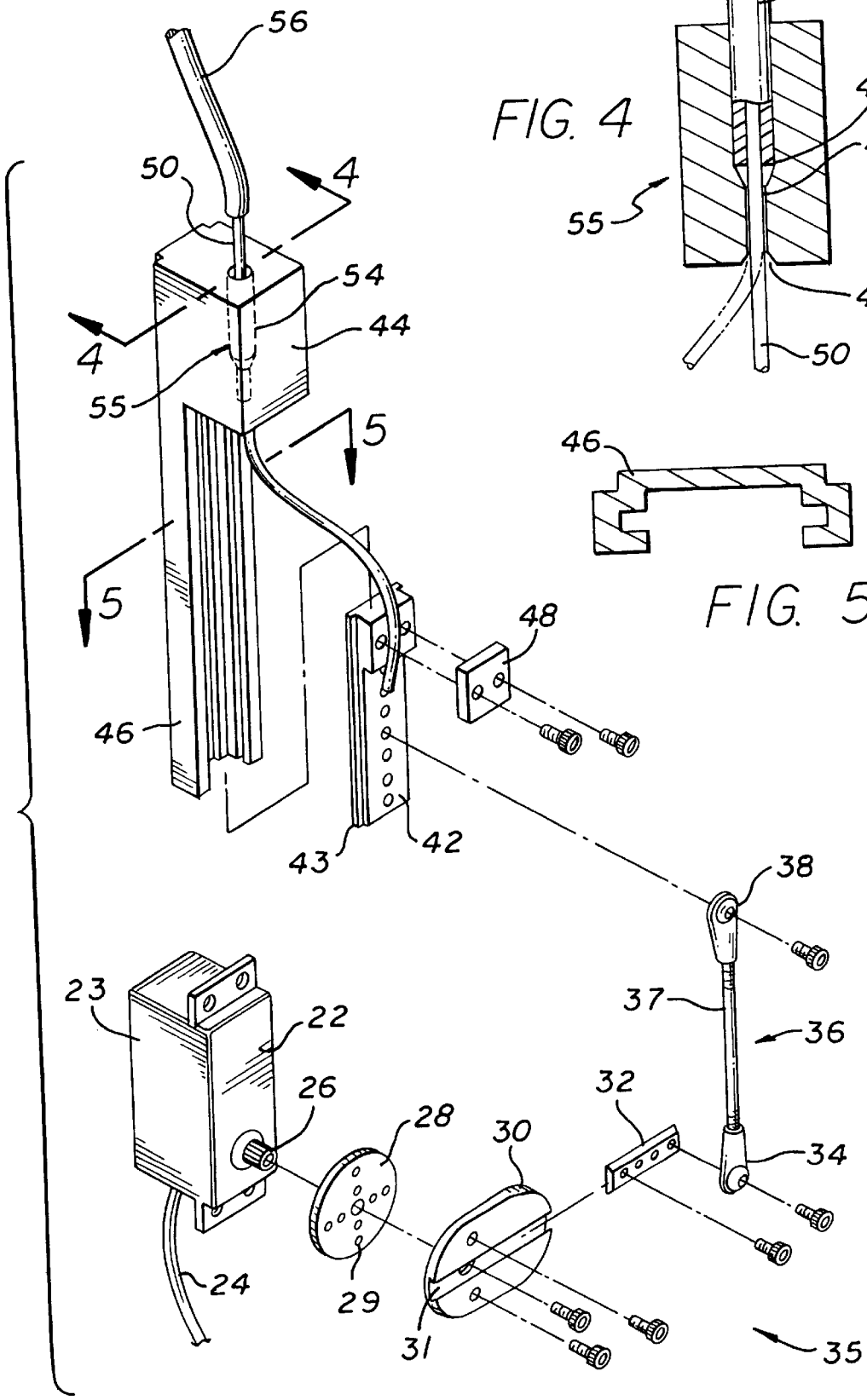
FIG. 4
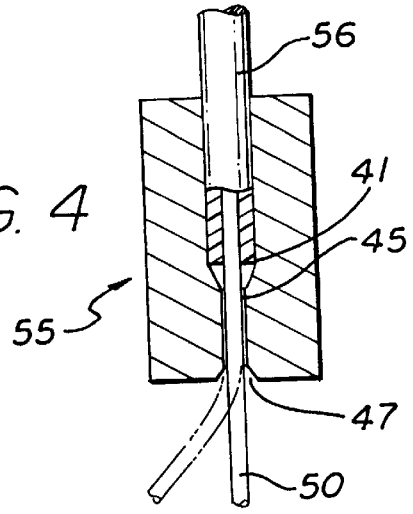
FIG. 5

FIG. 10
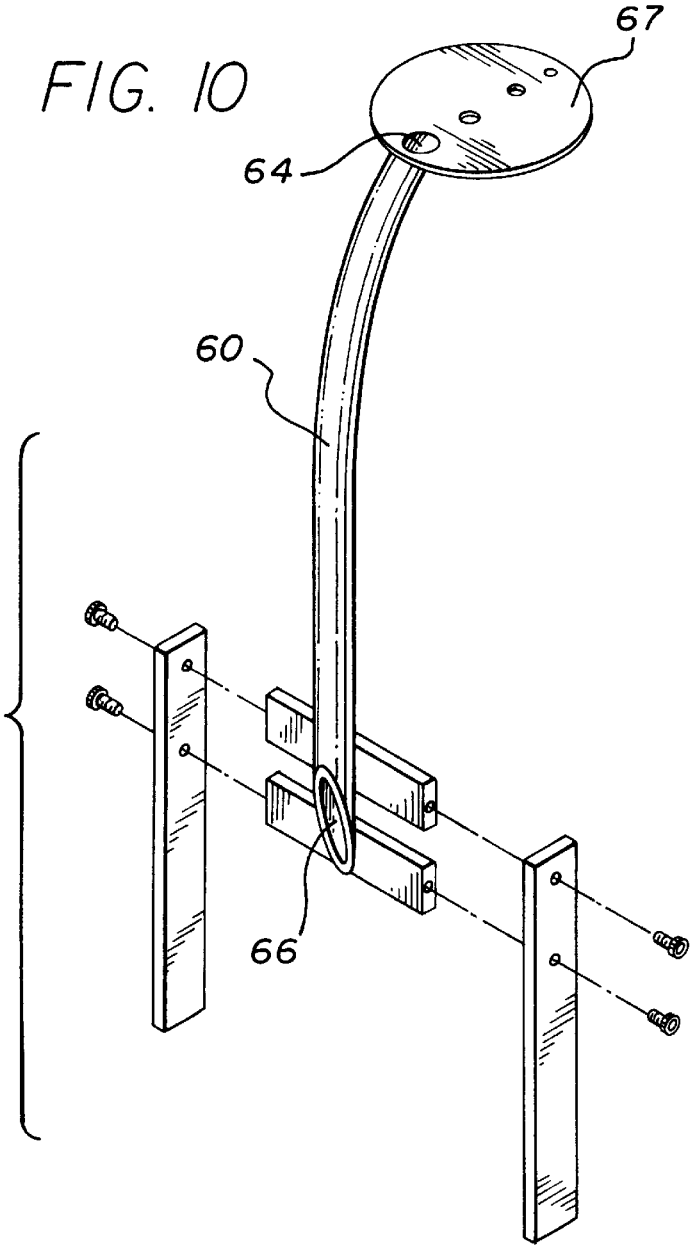
FIG. 11
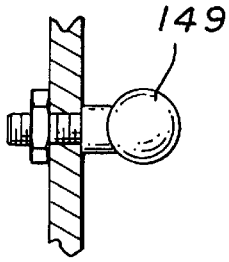
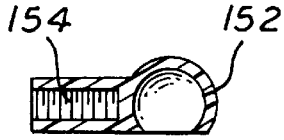
FIG. 12
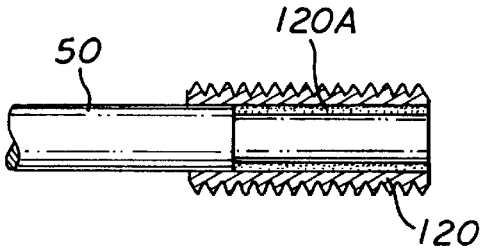
FIG. 13
FIG. 14
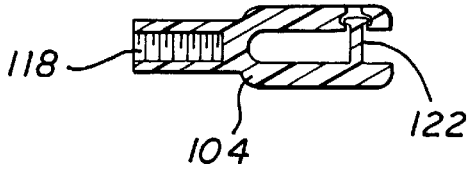

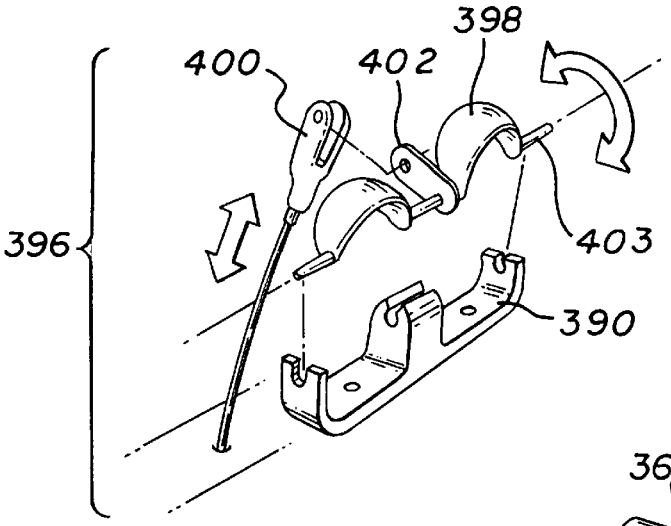
FIG. 16
FIG. 17
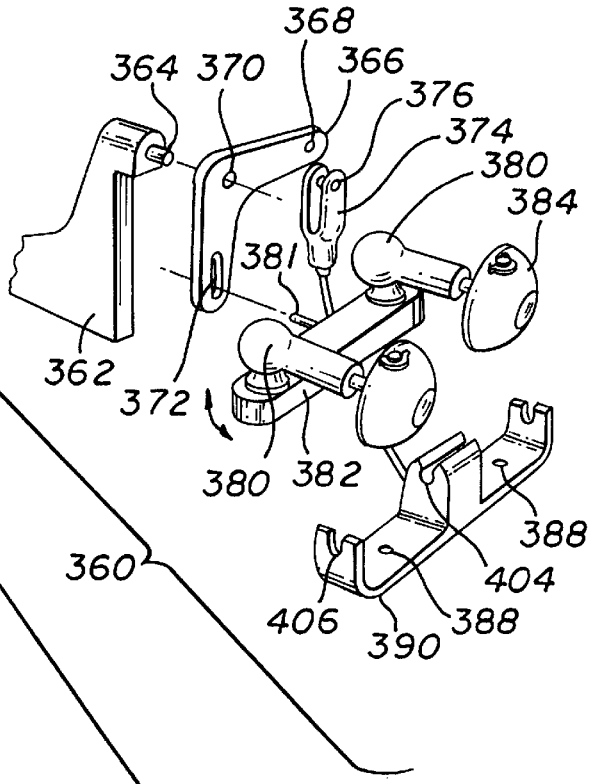
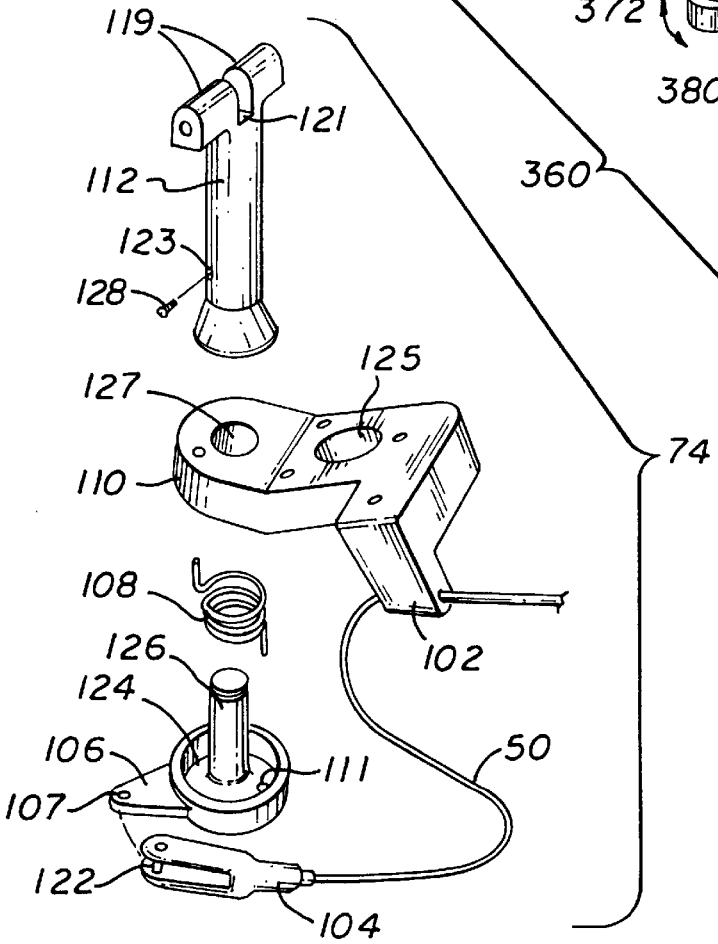
FIG. 18

FIG. 19
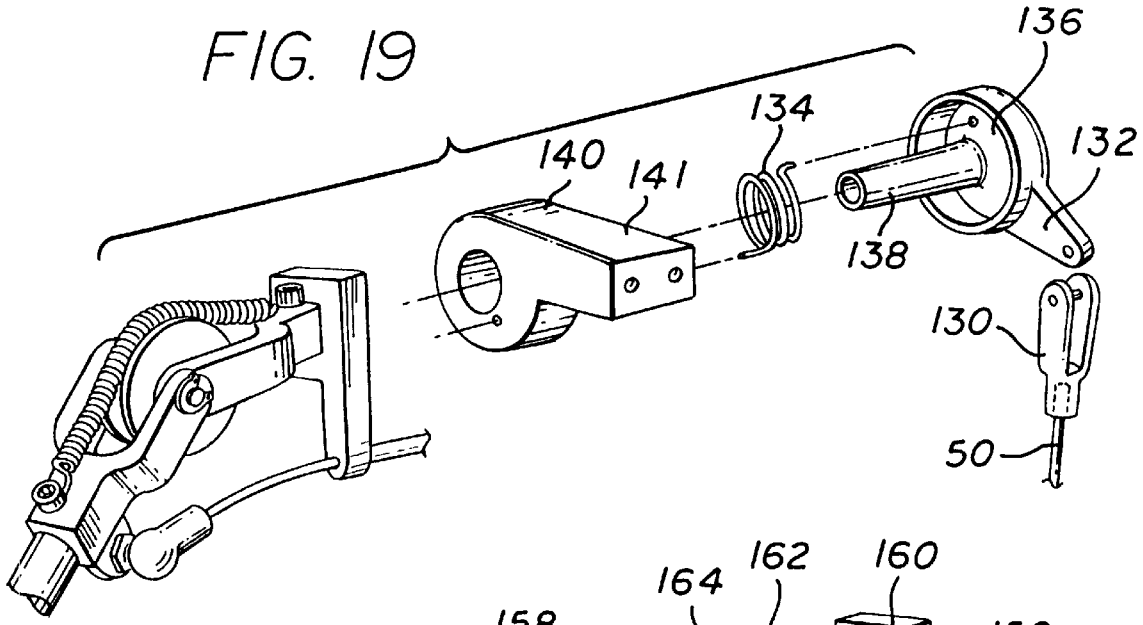
FIG. 20
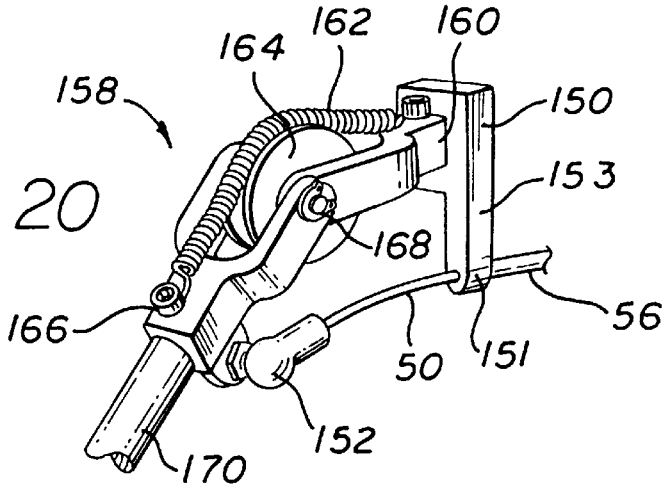
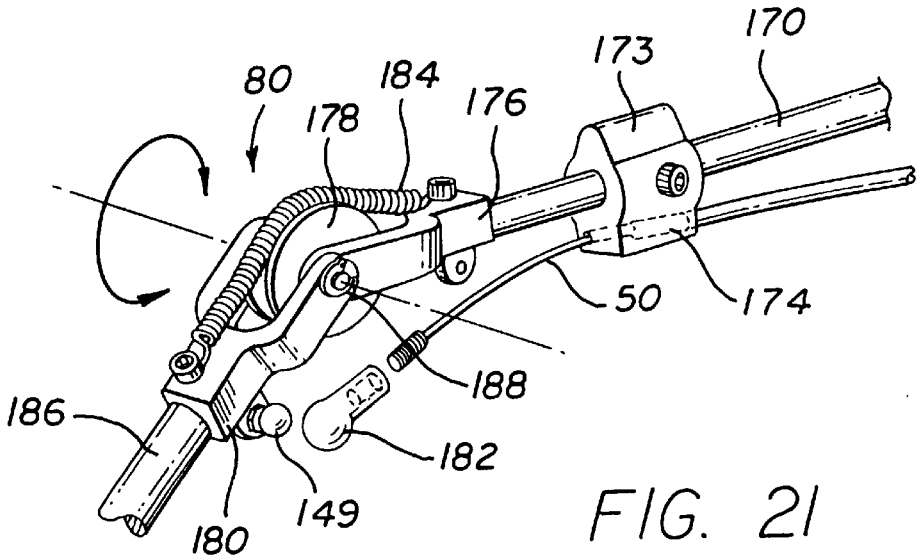
FIG. 21

APPARATUS FOR CONTROLLING AN ANIMATED FIGURE

The present invention relates generally to animated figure systems and, more particularly, to a method and apparatus for controlling an animated figure.

BACKGROUND OF THE INVENTION

In theme parks such as Disneyland® Park and Walt Disney World® Magic Kingdom, it has long been the practice to present characters using AUDIO-ANIMATRONICS® figure systems for controlling movement of an animated figure. Such a system typically includes large or "human size" figures controlled by hydraulic and/or pneumatic actuation requiring complex control systems.

The existing system has several problems and disadvantages. One is that the hydraulic and/or pneumatic actuation systems for achieving animation of the figures are extremely expensive, and require special electronic power requirements and complicated control circuitry. Further the hydraulic and/or pneumatic actuation systems are relatively large. These actuation systems have many moving parts and consequently many potential failure points. The failure of a hydraulic actuation system can also result in high pressure hydraulic fluid leaks that could pose a danger to guests if they were permitted to come within a close proximity of the animated figure. Thus, because of the potential for this type of failure a predetermined distance separating each animated figure from the guests is necessary, which significantly limits the caliber of the animated figure presentation.

A related problem with using the traditional animated figure systems relates to the expensive site and installation infrastructure. Temporary installations in compact locations like store windows and theater lobbies are not feasible. Specifically, because of the size requirements, failure potential and complex control systems, each installation of an existing system requires a large and permanent location.

Another disadvantage is the expense associated with the existing system. The cost of acquiring and maintaining the hydraulic and/or pneumatic actuation systems, each having complex control systems, is substantial. In addition, the programming for making the animated figures perform is very expensive. Accordingly, having a simpler improved animated figure system to implement animation or motion of figures without pneumatics and/or hydraulics is important.

An animated character system is described in U.S. Pat. No. 5,289,273 to Lang. This system includes servo control units and signal receivers within or on the animated character itself. The servo units of this system connect to control wires for moving parts of the animated character. For controlling the servo units of this system, radio frequency control signals are sent to receivers associated with the servo control units. The character has some type of outerwear (i.e., skin or clothing) to hide the character's internal mechanisms. While this system avoids some problems related to having pneumatic and hydraulic systems, several problems still exist in such a system.

One such problem relates to the use of multiple servo control units and multiple receivers within the animated character. Having this additional structure within the character presents a bulky and heavy character. Thus, this type of system requires additional control and power requirements for moving portions of the animated character. In addition, the animated character experiences the effects of inertial forces caused by this additional structure within the character. Also, this additional structure causes vibrational problems for the overall system. As a consequence, this system's animated character, whether at rest or moving, requires relatively complex control systems and powerful motors to overcome the effects associated with having this additional structure within the animated character. As a result, the overall system is relatively costly.

Another problem relates to the servicing or maintaining of the overall system. For example, when modifications or adjustments to the servo control units are necessary, someone must make adjustments within the animated character that may cause further problems with the character. In addition, before servicing the additional structure within the character, such as a servo unit, the animated character's outerwear must be removed. This is time consuming and in some instances the outerwear must be completely replaced after repairing the character adding to the overall cost of maintaining the character.

Similarly, adjusting or tuning various parts of this animated character is time consuming and inefficient. Typically overtime adjustments must be made to the mechanical linkages of an animated character. On this system, for example, an adjustment to the control wire connected at the servo control unit again requires modifications on the animated character. As a result, easy rapid adjustments are difficult in such a system.

Another disadvantage of this system is that it is not modular. More specifically, for implementing various characters, such as different animals or human-like figures, the character must be completely redesigned. This system's animated character includes custom assemblies with dedicated servo units at or near a point of movement. Such assemblies can be quite complex because no commonality exists from one movement assembly to the next. If a different animated character is required for a specific presentation, custom assemblies must be constructed for that specific character and significant effort must be expended in designing and constructing the new animated character. Further, the assemblies for these specific characters often would be much different. Thus, the movement assemblies used in one character is virtually useless in designing and constructing another character.

Another system is described in U.S. Pat. No. 5,393,058 to Rowland et al. This system includes a golf figure with three pulleys, that is, a waist-bend pulley, a waist-twist pulley and a third pulley permitting the golfer to move its arms. Each pulley is mounted within the golfer figure. Further, the golfer figure is clothed to conceal the structure of the figure. Strands of cable from a motor spindle are wrapped several times around an associated pulley. Thus, for moving an axis of the golfer figure, at least two strands of the cable are required. This patent states that single cable systems have problems concerning cable branching and torque requirements for motors. In an effort to overcome these problems and achieve elaborate cable branching having multiple cable bends as well as lower torque motors, the patent purported that it was necessary to use this double cabling method. These features, according to the patent, could not be done in single cable systems.

One problem with this system is that the resulting figure is not streamlined, but bulky and requires double cabling for each moving part of the golfer, that is each axis of the character's motion requires at least two strands of cable. Another problem relates to the added forces affecting the golfer. With the use of pulleys within the figure, the golfer experiences the effects of vibrational forces caused by this additional structure within the figure. Such forces prevent the golfer from appearing to move smoothly and thus taints the character's performance.

A further problem is that for implementing various characters, such as different animals or human-like figures, the character must be completely redesigned. Each of the three pulleys is dedicated to a specific movement within the golfer and each pulley is located at a specific axis of motion. To implement a different animated character a new character design incorporating specific dedicated pulleys is necessary. Not only is a specific design and construction required for each custom character, but the characters are quite bulky, and relatively difficult to adjust.

Thus, one will appreciate that there exists a need for a simpler improved method and apparatus for controlling an animated figure that is lighter in weight, more adjustable and modular, and easier to maintain. Further, there exists a need for such a method and apparatus to carry out animation of a figure without limitation to pneumatics and/or hydraulics and without additional structure mounted within the animated figure itself. Such a streamlined animated figure is easier to control and maintain, thereby improving the animated figure's overall presentation. Moreover, the method and apparatus should provide for elaborate cable branching having multiple cable bends, while also using lower torque motors. The present invention is intended to satisfy the above needs.

SUMMARY OF THE INVENTION

Briefly, and in general terms, the present invention resides in a method and apparatus for implementing an animated figure's movement in a relatively compact location without using servo mechanisms, pulleys or other additional mechanical structure within or on the figure itself. The present invention significantly increases the potential for installations in compact sites such as small self contained enclosures or on desktops. The animated figure apparatus of the present invention includes modular and adjustable features making it relatively inexpensive to manufacture and easy to maintain. Moreover, the apparatus attains its improved characteristics without hydraulic and/or pneumatic actuation. In addition, in the unlikely event of a maintenance problem, the modular architecture of the apparatus allows for rapid replacement or adjustment of the animated figure apparatus providing for very short downtime.

More specifically, an animated figure apparatus of the present invention includes an animated figure having moveable elements and a carousel base unit for supporting the animated figure. The apparatus of the present invention includes multiple control cables, a first end of each control cable connects to a cable driver assembly or cable driver mounted on the base unit and a second end of each control cable attaches to a corresponding animated figure moveable element. The cable drivers that are attached to the base unit drive the control cables, and propel the animated figure's moveable elements. The present invention achieves detailed control of many animated figure functions using intricate control cable branching which may require many bends in the control cable.

An important feature of the present invention is that each cable driver is not only mounted to the base unit but also spaced away from the animated figure. Such architecture advantageously reduces the animated figure's size and weight. This architecture also results in a streamlined animated figure and one that is easily manipulated with less complicated control mechanisms. In addition, the animated figure apparatus is easier to maintain because servicing of the cable driver assemblies does not require changes within the animated figure.

Moreover, this design advantageously provides a generic overall design. Because the animated figure is independent from the cable drivers, constructing and designing various animated figures, such as, different animals or human-like figures, of the present invention is easier. Further, the apparatus of the present invention is modular because each movement assembly is constructed of similar parts and various components can quickly be removed and replaced. This architecture also permits the cable drivers to receive electronic signals for controlling the cable drivers via wires terminating at the cable drivers, away from the animated figure, enhancing the figure's attributes.

Another feature of the present invention is that the base unit is removably attached to a platform. Such architecture improves the modularity of the present invention. The animated figure, its base unit, the cable drivers within the base unit, and the control cables are quickly exchangeable with another base unit by simply removing the base unit from the platform and attaching another base unit. This allows for another presentation of a similar animated character or a quite different animated character quickly and easily.

A further feature of the present invention is that the cable drivers are peripherally mounted around the base unit. This unique architecture provides easy access, without disassembly, to the vital cable driver assemblies and the ends of the control cables that are connected to respective cable drivers. Such a design makes adjusting or replacing multiple components easier, provides for relatively inexpensive assembly, and increases the overall modularity of the present invention.

More specifically, in a presently preferred embodiment by way of example, another feature of the present invention is that each control cable has a low friction coating and is fed through a separate low friction coated cable cover. Therefore, a low power and low cost cable driver can smoothly pull each low friction cable through the associated low friction cable cover even with multiple bends in the control cable. Such a low friction design reduces the requirements of each cable driver, while at the same time, the design increases the functionality of driving the animated figure's moveable elements.

Yet a further feature of the present invention is an improved cable driver assembly, also referred to as cable driver. Each cable driver assembly includes a cable slider attached to a control cable, driving rod and servo mechanism. The servo mechanism is connected to the lower end of the driving rod and the cable slider is connected to the upper end of the driving rod. In response to a control signal, the servo mechanism propels the driving rod causing the cable slider to move linearly. Accordingly, each cable slider propels a control cable. Thus, each control cable of this unique design drives a moveable element of the animated figure.

The unique design of the cable driver assembly translates the rotary motion of the servo mechanism into a linear motion with each cable slider guiding its control cable in a straight linear motion. This design permits smooth movement of each control cable and prevents any tangling of control cables at or near the cable driver assemblies. This translates directly into relatively more movements by the relatively small figure. In addition, lightweight components fit together and cooperate advantageously to provide a very modular, adjustable control cable driving assembly.

In addition, a walk mechanism provides both horizontal and vertical movement of the animated figure's feet to achieve the important feature of simulated stepping movements in a very realistic manner. Further, the walk mechanism in combination with a motion base allows the animated figure of the preferred embodiment to move about a set, such as a stage, by dancing, walking, running or other movements, thereby increasing the overall animation presentation significantly.

Additional features and advantages of the present invention will become apparent from the following description of the preferred embodiment, taken with the accompanying drawings, which illustrate, by further way of example, the principles of the invention.

BRIEF DESCRIPTION OF THE DRAWINGS

FIG. 3 is a perspective view with portions exploded, of a cable driver assembly used on the apparatus of FIG. 1 to move an element or assembly of the animated figure apparatus.

FIG. 4 is a cross section view, of a ferrule pathway used in FIG. 3 and throughout the animated figure apparatus.

FIG. 5 is a cross section view, of a vertical track used in the cable driver assembly of FIG. 3.

FIG. 10 is a perspective view, of a conduit used on the apparatus of FIG. 1.

FIG. 11 is a perspective view, of a ball post used on the apparatus of FIG. 1.

FIG. 12 is a perspective view, of a ball link connector used on the apparatus of FIG. 1.

FIG. 13 is a perspective view, of a threaded brass tube receiving a control cable used on the apparatus of FIG. 1.

FIG. 14 is a perspective view, of a clevis used on the apparatus of FIG. 1.

FIG. 16 is a perspective view with portions exploded, of an eye blink assembly used on the apparatus of FIG. 1 to move eye lids of the animated figure apparatus.

FIG. 17 is a perspective view with portions exploded, of an eye shift assembly used on the apparatus of FIG. 1 to move eyes of the animated figure apparatus.

FIG. 18 is a perspective view with portions exploded, of a head turn assembly used on the apparatus of FIG. 1 to move a head of the animated figure apparatus.

FIG. 19 is an exploded view, of a shoulder rotation assembly used on the apparatus of FIG. 1 to move an arm of the animated figure apparatus forward.

FIG. 20 is a perspective view, of a shoulder assembly used on the apparatus of FIG. 1 to move an arm of the animated figure apparatus outward.

FIG. 21 is a perspective view with portions exploded, of a elbow joint assembly used on the apparatus of FIG. 1.

DESCRIPTION OF THE PREFERRED EMBODIMENT

Figure 1:
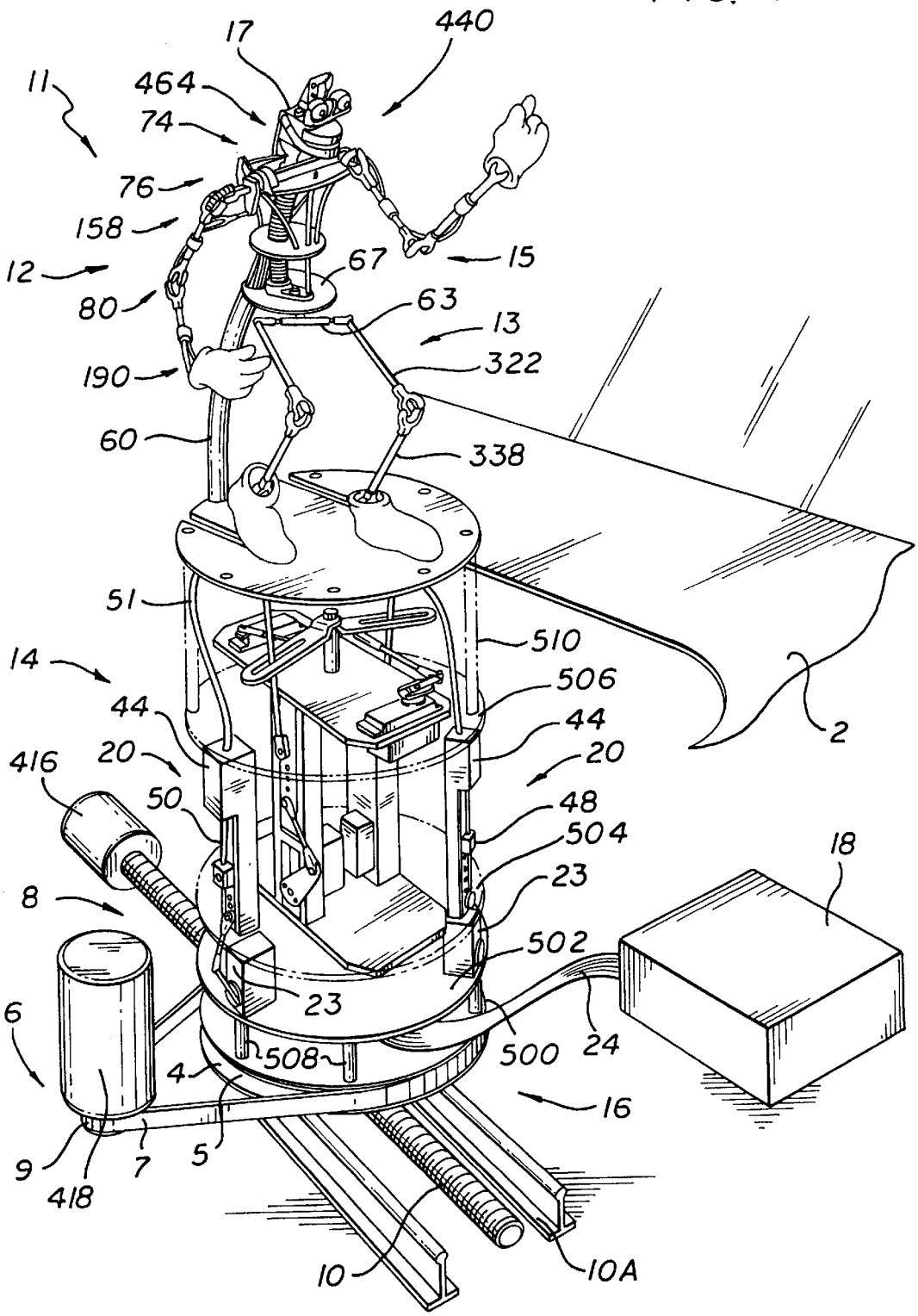
FIG. 1 is a perspective view of an animated figure apparatus, which helps illustrate the preferred apparatus of the preferred embodiment, according to the present invention.

As shown in the accompanying drawings, the present invention is embodied in a modular programmable animated figure apparatus, indicated generally by reference numeral 11 in FIG. 1. In the preferred embodiment, the apparatus includes a enclosure 2, an animated FIG. 12 having moveable element assemblies operable by a plurality of control cables 51, a cable conduit 60, a base unit, preferably a carousel base unit 14 with a plurality of peripherally mounted cable driver assemblies 20, also referred to as cable drivers, a motion base 16 and wires 24 capable of receiving electric signals. The animated figure apparatus may be controlled by a controller 18 which includes a power supply. Each control cable 51 preferably includes a control cable housing 56 and an inner control cable 50 (see FIG. 3).

The motion base 16 includes a turntable 4, a pulley assembly 6, and a linear actuator 8. The animated figure's moveable element assemblies include moveable elements of the animated figure like appendages on a body. The cable conduit 60 helps support the animated figure above the carousel base unit and receives a plurality of control cables 51 for operating the moveable elements of the animated figure. The carousel unit 14 is mounted on the turntable. The turntable includes a grooved rim 5 in which a belt 7 of the pulley assembly runs so as to turn the turntable. The pulley assembly includes a platform driver with a grooved rim 9 for receiving the belt 7 with the grooved rim driven by a pulley motor 418. The pulley assembly is mounted on the linear actuator. The controller may be wired to the motion base and carousel unit for controlling the animated figure apparatus.

The animated FIG. 12 having a lower portion 13 and an upper portion 15, and the cable conduit 60 are within the enclosure 2 and move about behind a top front edge of the enclosure. Preferably, the front edge of the enclosure masks the lower portion of the conduit, carousel base unit 14, and the motion base 16. Thus, the animated figure appears to move on a horizontal surface coincident with the top edge of the enclosure. The linear actuator 8 of the motion base moves the carousel unit 14 and animated figure linearly. The turntable 4 in cooperation with the pulley assembly 6 moves them rotationally. The controller may include a personal computer or other control device and may be programmed for playback or used to manipulate the apparatus in real time.

CABLE DRIVER ASSEMBLY

With reference to FIGS. 1 and 3, the cable driver assemblies 20 of the carousel base unit 14 provide force on corresponding control cables 50 connected to various movement assemblies of the animated figure for moving the moveable elements of the animated FIG. 12. Preferably, the cable driver assemblies are spaced away from and beneath the animated figure. Such architecture advantageously reduces the animated figure's size and weight, resulting in a streamlined animated figure. In addition, the animated figure apparatus is relatively easy to maintain because servicing the cable driver assemblies does not require changes within the animated FIG. 12 and the cable driver assemblies are adjustable. The animated figure can perform in relatively compact locations without using servo mechanisms, pulleys or other additional mechanical structure within or on the figure itself.

The cable driver assemblies 20 are peripherally mounted around the carousel unit for rendering a force on the respective control cables 50. Each cable driver assembly includes similar parts, including a servo motor 22, a crank assembly 35, a track assembly, and three wires 24 carrying electrical signals corresponding to electrical power, ground and a pulse-width modulation signal. The servo motor is enclosed in a housing 23. The housing has a pair of flanges with mounting holes for attaching the servo motor to the carousel unit. Extending from the housing is a rotatable servo shaft 26 that is actuated by the servo motor. The servo shaft has a splined exterior surface and a threaded bore. A servo plate 28 having a central opening is mounted on the servo shaft and held in place by a fastener received through the central opening into the threaded bore of the servo shaft. The servo plate mounts on the servo shaft such that the servo plate rotates when the servo shaft rotates. The servo plate also has threaded holes 29 for mounting the crank assembly.

The crank assembly 35 includes a servo crank 30, a crank arm 32 and a shaft 36. The servo crank is elliptically shaped and has a generally central opening. The servo crank is mounted to the servo shaft and held in place against the servo plate by a fastener received through its central opening. Additional holes may be provided for direct mounting to the servo plate 28. The servo crank also has a dovetail channel 31 through the length of the servo crank. The crank arm 32 is an elongated wedged shaped member that fits into the corresponding dovetail channel 31 of the servo crank. The shaft 36 includes a rod 37 having upper and lower threaded ends. Mounted to each end of the rod is a sheath and a swivel ball joint 34, 38 having a threaded bore for receiving a respective end of the threaded shaft 37 and a hole for receiving a fastener to permit mounting. The crank arm includes a plurality of holes to permit adjustment of the shaft at selected distances from the rotational axis of the servo shaft 26. The lower sheath and swivel ball joint 34 are mounted in an opening of the crank arm to permit swivel movement. The sheath and swivel ball joint 38 of the upper end of the shaft has a hole for mounting to the track assembly.

The track assembly includes a track unit 44, a cable slider 42, and a slide block 48. The track unit has a rectangular block shape having a protruding upper portion and a lower portion housing a vertical track 46. The vertical track 46 is a three-sided rectangular channel with overhanging edges. The upper portion of the track unit 44 has a cable pathway 54 extending completely through the track unit's upper portion. Within this cable pathway is a ferrule pathway 55, described below.

The cable slider 42 has a rectangular block shape having a protruding upper portion and a lower portion with a plurality of holes for attaching the cable slider to the crank assembly. The plurality of holes on the cable slider permit adjustment of the shaft. The cable slider has flanges 43 protruding outwardly extending along its lengthwise sides that are cooperatively received in the vertical track 46 of the track unit 44. This cable slider 42 and track unit 44 configuration provides almost no friction on the back side of the cable slider allowing for relatively easy and smooth movement of the cable slider. The upper portion of the cable slider has holes for clamping the cable slider and the slide block 48 together. The slide block may be sized to match the upper portion of the cable slider and includes holes for receiving pins for clamping the slide block to the cable slider's upper portion.

The cable pathway 54 accepts a cable 50 and its cable housing or cover 56 through the top of the track unit 44. Within this cable pathway is the ferrule pathway 55. Now with reference to FIG. 4, the ferrule pathway is a countersink bore, having a pathway with a conical opening 41 leading to a smaller diameter pathway 45. The conical opening 41 of the ferrule pathway 55 has a large enough diameter to receive and hold the cable housing 56. Also, there is a conical opening at the opposite ferrule pathway end 47. The ferrule pathway's smaller inner diameter is large enough to receive the control cable 50 but too small for its cable housing 56. Thus, the ferrule pathway prevents the cable housing from extending any further into the pathway and allows the inner cable 50 of the cable housing 56 to extend completely through the ferrule pathway. Ferrule pathway's are at both ends of each control cable, that is within each cable driver assembly and within a movement assembly on the animated figure. Thus, opposite ends of the cable housing 56 are within opposite ferrule pathways which trap the cable housing between the ferrule pathways allowing the inner control cable 50 to move within the cable housing 56 while the cable housing stays fixed. The configuration of this pathway advantageously reduces abrasion to the control cable 50 and cable housing 56 during movement of the control cable and is referred to herein as a ferrule pathway 55. This unique ferrule pathway is used frequently in the preferred animated figure apparatus wherever the cable housing is restrained and the inner control cable 50 extends therefrom.

With reference to FIGS. 1 and 3, the ferrule pathway 55 of the track unit 44 allows the inner cable, the control cable 50, to extend completely through the cable pathway 54 in the track unit's upper portion and is routed to the cable slider 42 for clamping the control cable 50 between the slide block 48 and the cable slider 42.

Once the cable driver assembly receives a pulse-width modulation signal from the controller 18 the servo shaft 26 rotates and the crank assembly 35 rotationally follows the angular displacement of the servo shaft 26. The crank arm 32 acts on the shaft 36 propelling the cable slider vertically within track 46. As a result, the rotational movement of the servo shaft is converted into a linear cable slider movement. The plurality of cable driver assemblies 20 are very similar and each has a corresponding control cable 50 for moving a corresponding cable slider 42.

The type of servo motors of the cable driver assemblies 20 are preferably JR SuperServo NES-4000 supplied by JR Industries. These servo motors are 4.8–6 volt servos providing 5.3 kg-cm torque and with a movement rating of 0.19 seconds per sixty degrees. The control cable and cable housing of the preferred embodiment both have a low-friction coating, such as, TEFLON coating which is available from W. L. Gore and Associates. Use of this type of cable and cable housing in the present invention provides very little friction between the cable and the cable housing allowing the inner control cables to move smoothly. Thus, the cable driver assemblies propel the control cables with relatively less force. In the preferred embodiment, the inner control cable is coated and moves within a coated cable housing. Further, even with the multiple bends necessary to implement the many functions of the preferred embodiment, the servo motors have relatively less torque requirements for manipulating the animated figure of the present invention.

CABLE CONDUIT

With reference to FIGS. 1 and 10, a hollow conduit 60 has two ends, an upper end and a lower end. The conduit 60 is hollow defining a somewhat vertically extending guide channel for guiding the plurality of control cables 50 and their corresponding cable housings 56 from the peripherally mounted cable driver assemblies 20 to associated moveable elements of the animated FIG. 12. At the upper end of the conduit there is an opening 64. Multiple openings may be provided to permit different exit openings for various cable routing of the plurality of control cables 50 from their corresponding peripherally mounted cable driver assemblies through the conduit to each of the animated figure's moveable element assemblies.

There is one opening 66 at the conduit's lower end which receives various control cables which are individually secured to the cable driver assemblies 20. The conduit is mounted and fastened at its lower end to the carousel base unit 14 and at its upper end to a torso section 62 of the animated figure. Also, in the preferred embodiment at the conduit's upper end, an integral platform 67 horizontally protrudes from the conduit's guide channel.

Figure 9:
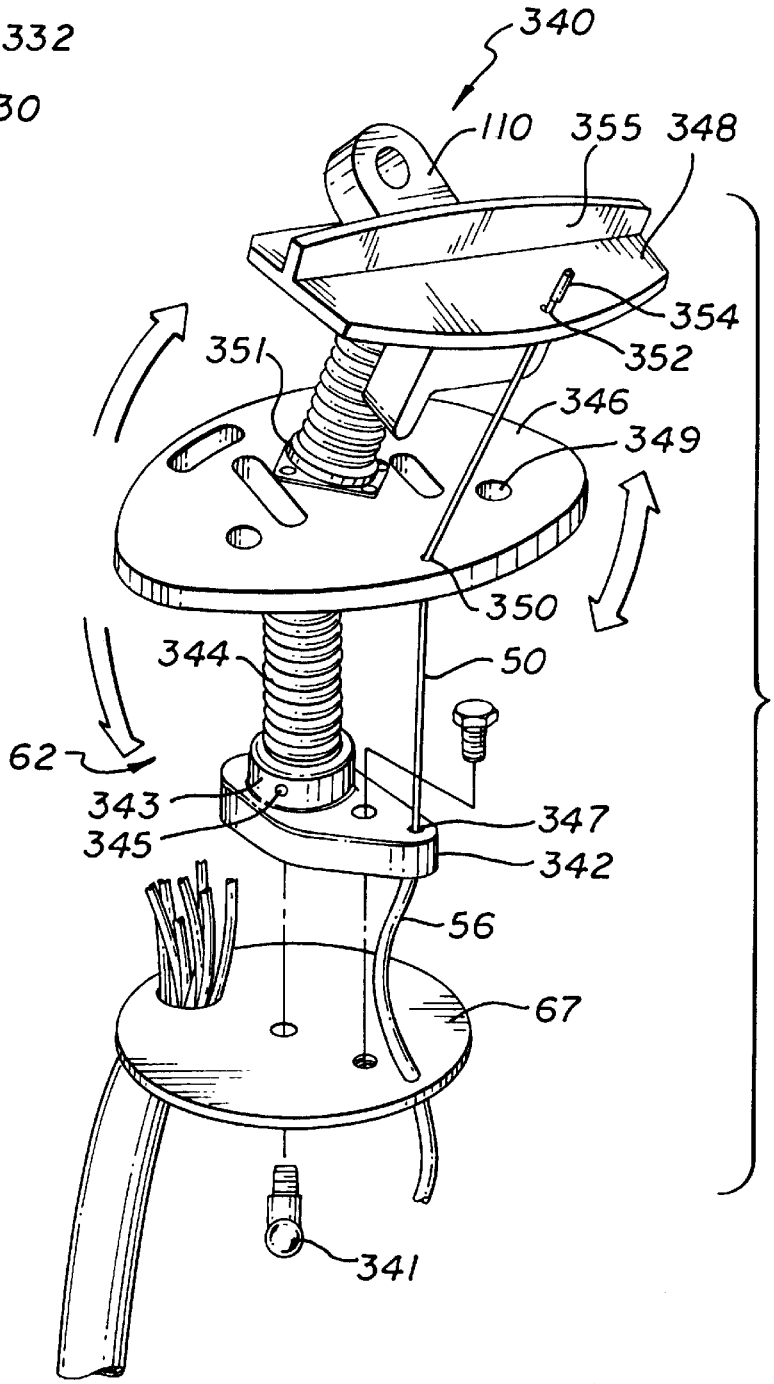
FIG. 9 is a perspective view, of a torso bend assembly used on the apparatus of FIG. 1 to move a torso section of the animated figure apparatus and its relationship to a cable conduit.

With reference to FIG. 9, the top of the platform 67 is fastened to a pelvis plate 342 for supporting the torso section 62 of the animated figure. The bottom of the conduit platform includes a hole for receiving a ball post 341, the ball post is fastened to the conduit platform and the ball post is used for connection to a waist member 63 (FIG. 1) of the animated figure having a ball link connector. The ball post extending from the bottom of the conduit's platform 67 allows the waist member 63 of the animated figure's lower portion 13 to snap onto the conduit's platform quickly and easily. This feature also allows for quick removal and replacement of the lower portion of the animated figure. While each moveable element assembly may provide independent movement in response to a corresponding control cable, some differences exist between these assemblies, and therefore, some of the animated figure's linkages, of the preferred embodiment, will be described in detail.

ANIMATED FIGURE

With reference to FIG. 1, in the preferred embodiment, the animated figure having an upper portion 15 consists of a plurality of movement assemblies for moving various elements or appendages of the animated figure. These assemblies are the mouth assembly 440, head nod assembly 72, head turn assembly 74, shoulder rotation assembly 76 (i.e., right arm forward assembly or left arm forward assembly), shoulder assembly 158 (i.e., right arm out assembly or left arm out assembly), elbow joint assembly 80 (right or left), wrist joint assembly 190 (right or left), torso bend assembly 340 (FIG. 9), eye blink assembly 396 (FIG. 16), and eye shift assembly 360 (FIG. 17). The lower portion 13 of the animated figure includes a waist member 63, upper thigh members 322, lower legs 338, foot supports 294 and knee joint assemblies 320 (FIG. 8) for jointably connecting the thigh members to the lower legs.

Figure 8:
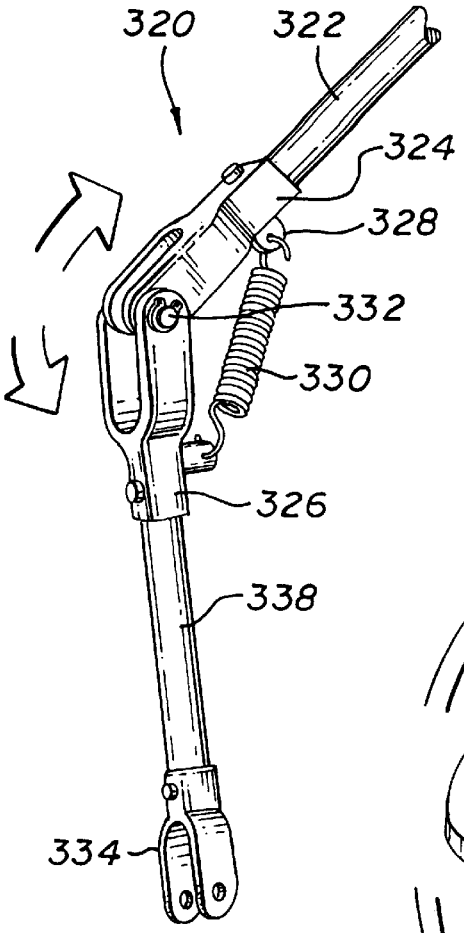
FIG. 8 is a perspective view, of a knee joint assembly used on the apparatus of FIG. 1 showing the upper portion of a leg rotationally coupled to the lower portion of a leg.

In the preferred embodiment, light weight tubing is used to form many of the animated figure's appendages, for example the lower portion of the animated figure includes the waist member 63, two thigh members 322 each connecting to a corresponding lower leg member 338 through a knee joint assembly 320 (FIG. 8). The animated figure's upper portion 15 also includes light weight tubing used to form upper portion moveable elements. The preferred tubing is carbon fiber tubing supplied by California Carbon Advanced Materials. Used in the present animated figure apparatus, this type of tubing provides for a relatively light weight animated figure allowing for easier and faster animation of the figure with less costly control mechanisms. For similar reasons, light weight components are preferably used wherever possible in the present animated figure apparatus.

HEAD TURN ASSEMBLY

With reference to FIG. 18, in response to a corresponding cable driver assembly the head turn assembly 74 causes a head of the animated figure to move from side to side. The head turn assembly includes a neck ferrule pathway 102, a clevis or snap-link 104 for receiving a control cable 50, a lever arm 106, a torsion spring 108, a neck bushing 110, and a neck 112. The preferred neck ferrule pathway is a ferrule pathway, as described above, through the neck bushing. Thus, the ferrule pathway prevents the respective cable housing from extending through the pathway and allows the inner cable 50 of the cable housing 56 to extend completely through the neck ferrule pathway and bushing.

The clevis 104 of the head turn assembly, is a Y-shaped piece of plastic which receives a cable at its base and the other side of the clevis has holes in its ends through which a pin 122 is run. The clevis includes a bore or axial hole 118 at its base end, tapped for a receiving a threaded brass tube 120 (FIGS. 13 and 14). The threaded brass tube is sized to receive the control cable 50. The brass tube receives the cable 50 and the cable is soldered to the brass tube for securing the cable to the brass tube. Preferably the cable 50 has a low-friction coating and this coating should be stripped away so that solder 120A will join the cable and brass tube 120 (FIGS. 13 and 14). With reference to FIG. 18, the lever arm 106 of the preferred embodiment is a circular piece of plastic with a wedge shaped piece extending radially therefrom including a well 124 extending around the circular portion with a spindle 126 extending orthogonally from the center of the lever arm's circular portion. The lever arm 106 includes a hole 107 near its apex. The well 124 has a mounting hole 111. The retaining pin 122 of the clevis is received by the lever arm hole 107 for rotatably connecting the lever arm to the clevis 104 and the cable 50. A torsion spring 108 has two ends and is spiral wound with an opening for receiving the spindle such that one end of the spring may be mounted to the hole 111 within the lever arm's well 124. The neck bushing 110 is rectangular shaped with a rounded end on one side and a bevel leading to the other end where a block protrudes from a corner. At its rounded end a hole 127 exists in the bushing for receiving the spindle and allowing it to pass through the bushing. A hole 125 exists in the bushing for receiving a spine spring 344 of the torso bend assembly 92, discussed below. The protruding block includes the cable ferrule pathway 102 for restraining the cable housing and guiding the inner cable 50 through and out of the protruding block. The neck 112 of the animated figure is a T-shaped tubular piece with a slight taper at its base. The base has an elongated bore for receiving the spindle 126. At its other end two symmetrical flanges 119 extend outward with a gap 121 between the flanges. A mounting hole 123 located near the base of the neck and just beyond the taper portion receives a pin 128 for securing the spindle to the neck 112. Thus, the spindle extends from the lever arm 106 through the torsion spring 108 and it also extends completely through a hole within the neck bushing 110 and into the animated figure's neck 112. One end of the torsion spring 108 is mounted within the well surface 124 and the other end of the spring is mounted to the neck bushing. The neck is connected to a head 17 (FIG. 1) of the animated figure such that, when the associated cable driver assembly 20 causes the clevis 104 to move the lever arm 106, the spindle rotates. Since the animated figure's neck is coupled to the spindle, it rotates with the spindle causing the figure's head to turn.

SHOULDER ROTATION ASSEMBLY RIGHT ARM FORWARD AND LEFT ARM FORWARD

With reference to FIG. 19, the shoulder rotation assembly (i.e. the right arm forward 76 assembly and the left arm forward assembly) causes an arm of the animated figure to rotate about a horizontal shoulder axis forward. This assembly has similar parts to the head turn assembly, described above. In the preferred embodiment there are two similar shoulder rotation assemblies and only one is described below. The shoulder rotation assembly includes a shoulder rotation ferrule pathway for restraining a cable housing but allowing the cable 50 to extend therefrom (not shown), a Y-shaped clevis 130 for receiving a cable 50, a lever arm 132, a torsion spring 134, and a shoulder bushing 140. The shoulder bushing 140 is a donut-shaped piece with an opening for receiving a spindle 138. The shoulder bushing also includes a rectangular cube 141 perpendicular to the spindle and extending from the upper portion of donut-shaped piece. The end of the rectangular portion of the shoulder bushing includes two holes for mounting to a flange 355 of a flat rectangular chest plate 348 of the animated figure (FIG. 9). The other shoulder bushing within the other shoulder assembly is mounted in the same manner to the opposite side of the chest plate.

Similar to the interconnection of the clevis, lever arm and spring described above (FIG. 18), opposite the end of the clevis receiving the cable, the clevis 130, is fastened to the lever arm 132 and thus connected to the cable 50. Again, the lever arm includes a circular well 136 and a spindle 138 extending therefrom. The torsion spring 134 is mounted at one end in the lever arm's well and at the other end to the shoulder bushing 140. The spindle 138 extending from the lever arm extends through the torsion spring and the shoulder bushing 140. The other side of the shoulder bushing connects to a shoulder assembly of the animated figure as described below (FIG. 20). Thus, similar to the head turn assembly, when the corresponding cable driver assembly 20 operates to pull the cable connected to the clevis 130, with a force greater than the torsion spring's return force, the animated figure's shoulder rotates, moving an arm forward if the arm is at the figure's side. If the arm is stretched outward the shoulder rotation assembly causes the figure's arm to rotate.

SHOULDER ASSEMBLY RIGHT ARM UP (OUT) AND LEFT ARM UP (OUT)

With reference to FIG. 20, the animated figure includes two shoulder assemblies for causing a left or right arm to move upward from the animated figure's side or back downward. In the preferred embodiment, there are two similar shoulder assemblies, one is described below. A shoulder assembly 158 is connected to and adjacent a corresponding shoulder rotation assembly such as the shoulder rotation assembly 76, described above (FIG. 19). The shoulder assembly 158 includes a shoulder ferrule 150, a ferrule pathway 151 through the shoulder ferrule, a shoulder clevis 160, a tension spring 162, a shoulder pulley 164, an upper arm clevis 166, a ball link connector 152 and a tubular upper arm 170. The shoulder ferrule is a P-shaped piece with a square opening. A leg 153 of the P-shaped shoulder ferrule includes the ferrule pathway 151 having a similar ferrule pathway design, as previously described, for receiving and restraining cable housing 56 and allowing the inner cable 50 to pass through. The Y-shaped shoulder clevis 160 has a single end with a mounting pin and at a U-side of the clevis two holes are provided for fastening the clevis 160 to the pulley 164 and upper arm clevis 166. The pulley 164 is circular with a grooved rim and a hole 160 extending through the center of circular the pulley. The upper arm clevis 166 is similar to the shoulder clevis having a round opening for receiving the tubular upper arm 170. Attached to the single side of the upper arm clevis is a post with a dome protruding from the upper arm clevis for connecting the ball link connector 152. As shown in FIGS. 11 and 12, a ball post 149 of a ball link connection includes the ball link connector 152 having a bore or axial hole 154, tapped for receiving a threaded brass tube 120 (FIG. 13). The brass tube receives the cable 50 and the cable is soldered to the brass tube for securing the cable to the brass tube. Preferably the cable 50 has a low-friction coating and this coating should be stripped away so that solder 120A will join the cable and brass tube 120.

With reference to FIG. 20, the square opening of the shoulder ferrule 150 receives the single end of the shoulder clevis 160. The ferrule pathway 151 is within the leg 153 of the shoulder ferrule for receiving the cable housing 56 and allowing only the inner cable 50 to completely extend from the shoulder ferrule. A pin 168 is run through both of the clevis' 160, 166 and the center of the circular pulley 164 for connecting these three parts together. The tension spring 162 mounts at the single end of each of the clevis' and extends over the grooved rim in the pulley 164. The upper arm 170 is received by the opening in the upper arm clevis 166. Preferably, the upper arm 170 is made of a light-weight carbon fiber-tubing as described above. As described previously, the ferrule pathway design of the preferred embodiment, restrains the cable housing 56 allowing the inner cable 50 to extend therefrom. A pulley pin 168 at the center of the shoulder pulley secures the shoulder clevis and the upper arm clevis to the shoulder pulley while allowing the pulley to rotate about the pulley pin. The tension spring is mounted at one end to the shoulder clevis and at the other end to the upper arm clevis by mounting pins. In operation, once the control cable 50 is, for example, pulled at a force greater than the tension spring's return force, the cable 50 retracts within the cable housing 56 pulling the ball link 152, causing the upper arm clevis to move downward rotating counter-clockwise about the pulley pin 168. As a result, the upper arm 170 moves towards the animated figure's body. Once a corresponding cable driver assembly of the shoulder assembly 158 returns to its neutral position, and the associated pulling by the cable driver assembly no longer acts to pull on the control cable 50, the tension spring acts to return the moveable element, such as the upper arm, to its neutral up position. This is preferably accomplished, as with the other spring returns in the preferred embodiment, by having a tension spring with a spring rate that exceeds the rotation speed at the servo shaft, thus keeping the cable in tension.

The tension spring acts to pull upward on the upper arm clevis, causing the upper arm to rise to its resting or normal position.

ELBOW JOINT ASSEMBLY

With reference to FIG. 21, an elbow joint assembly 80 is similar to the shoulder joint assembly as shown in FIG. 20. The elbow joint assembly allows an arm of the animated figure to pivot about an elbow within the arm. The elbow joint assembly includes an elbow ferrule 173, having a ferrule pathway 174, the upper arm 170 passing through the elbow ferrule, an upper elbow clevis 176, an elbow pulley 178, a lower elbow clevis 180 with attached ball post 149 for connecting to link 182, tension spring 184 and a lower arm 186. Similar parts are used in this and other assemblies further illustrating the modularity of this animated figure apparatus. The interconnection of parts in this assembly is similar to what has already been described. When the elbow control cable 50 is pulled at a force greater than the tension spring's return force, the cable 50 acts on the ball link 182, moving the lower arm 186 downward and about pulley pin 188 in a counter-clockwise manner. In operation of the preferred embodiment, once the corresponding servo shaft of the cable driver assembly 20 returns to its neutral position, and the pulling by the cable driver assembly no longer acts to pull on the control cable 50, the return force of tension spring 184 acts to return the moveable element, that is, the lower arm 186, to its neutral up position. The preferred elbow joint of the present invention exhibits a low profile, allowing outerwear or skin to fit tightly to the animated figure (not shown).

Referencing FIGS. 1, 20 and 21, in the preferred embodiment, very light weight tubing and parts are used to represent many of the animated figure's appendages, for example the animated figure's upper arms, lower arms, and legs. The tubing is lightweight and also connects the figure's various joint or movement assemblies. The preferred light weight tubing is carbon fiber tubing supplied by California Carbon Advanced Materials. The use of this type of tubing provides for a relatively light weight, streamlined animated figure allowing for easier and faster animation of the figure with less costly control mechanisms. For similar reasons, other light weight components are preferably used wherever possible in assembling the present animated figure apparatus of the preferred embodiment.

WRIST JOINT ASSEMBLY

Figure 22:
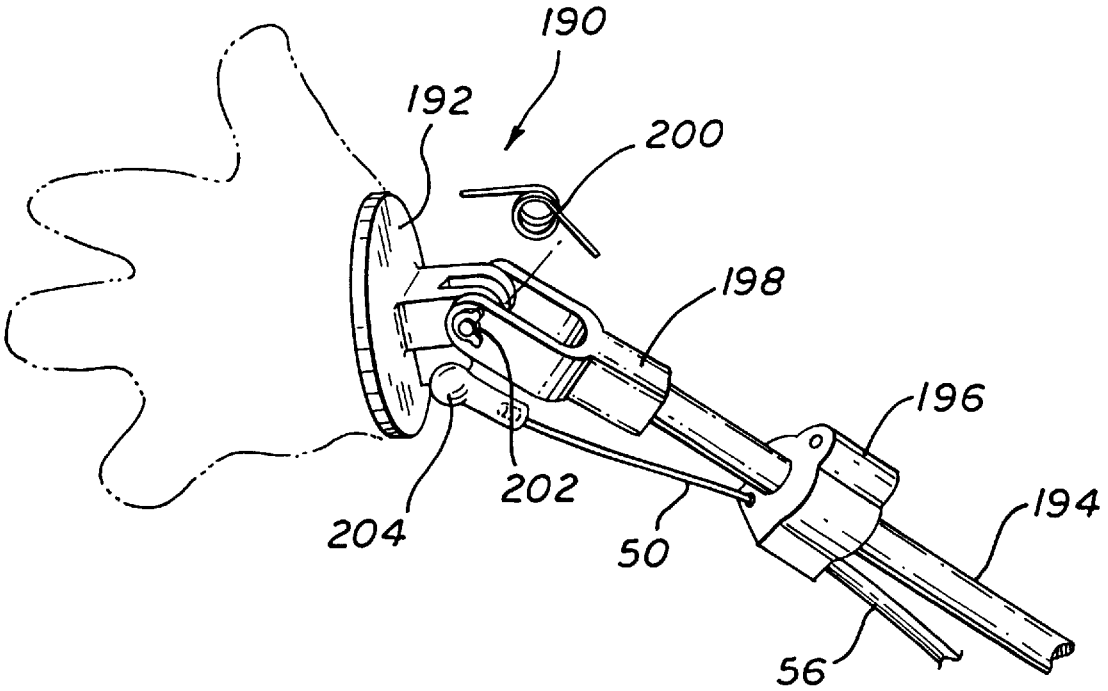
FIG. 22 is a perspective view with portions exploded, of a wrist joint assembly used on the apparatus of FIG. 1 to move a hand support of the animated figure apparatus.

With reference to FIG. 22, a preferred wrist joint assembly 190 includes the lower arm 194, a wrist ferrule 196 similar to the other ferrules having a ferrule pathway, a wrist clevis 198, a torsion spring 200, an axial pin 202, and a hand support 192 with an attached ball linkage 204. Similar to the other ferrule pathways of the preferred embodiment, the wrist ferrule pathway receives and restrains a cable housing 56 while allowing the inner control cable 50 to extend therefrom and connect to the ball linkage 204. The axial pin 202 joins the wrist clevis 198 and its connected lower arm to the hand support 192. The axial pin extends through the torsion spring 200 with one end of the torsion spring attaching to the wrist clevis 198 and the torsion spring's other end attaching to the hand support 192. Of course, it should be appreciated that since the animated figure can be presented as various figures, the structure should not be limited to the preferred embodiment of a hand support and arm. For example, the figure could be a dog with a paw pivoting from a leg or various other embodiments.

In operation of the preferred embodiment, once the wrist's control cable 50 is pulled at a force greater than the return force of the torsion spring 200, the control cable 50 acts on the ball linkage 204, moving the hand support 192 downward and about axial pin 202 in a counter-clockwise manner. When the associated servo shaft of the cable driver assembly 20 (FIG. 1) for this wrist assembly 190 returns to its neutral position, the return force of torsion spring 200 acts to return the moveable element, that is, the hand support 192, to its neutral up position. Preferably, the inner control cables of the present invention are low friction cables housed within a cable housing having a low friction pathway. With the use of a low friction cable 50 inside a low friction cable housing 56, the movement of the control cable and its return, may be accomplished with a smaller, less expensive cable driving apparatus.

WALK MECHANISM

Figure 2:
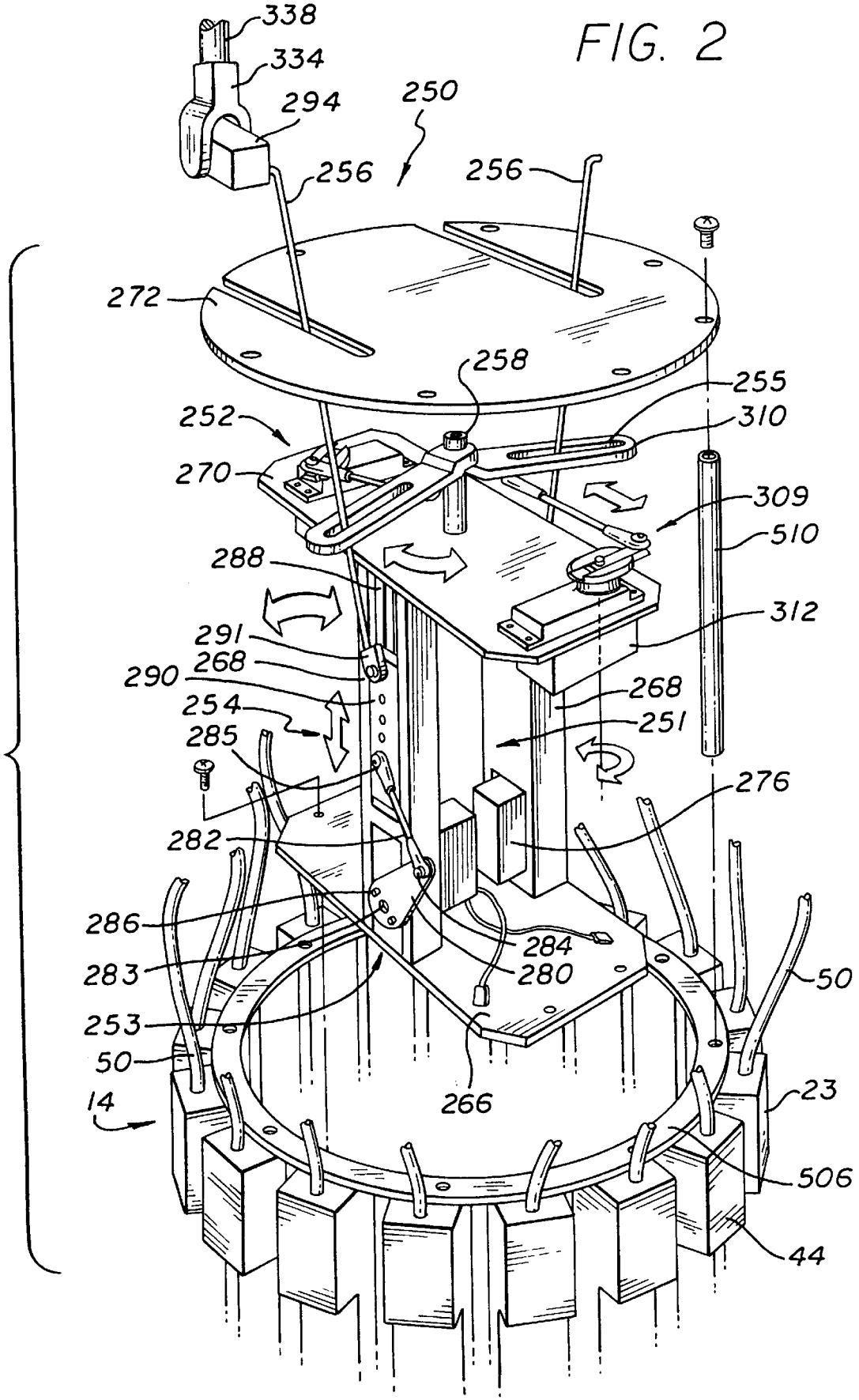
FIG. 2 is a perspective view with portions exploded, of a walk mechanism to move legs and feet of the animated figure; respective to a carousel base unit used on the apparatus of FIG. 1 that houses peripherally mounted cable driver assemblies, according to a preferred embodiment of the present invention.

With reference to FIGS. 1 and 2, a walk mechanism 250 uses similar parts for moving the animated figure's legs and feet as those parts of the peripherally mounted cable driver assemblies 20. The walk mechanism includes a walk mechanism housing, two walk driver assemblies, such as walk driver assembly 251, two walk bar assemblies, such as walk bar assembly 252, two push rods 256, and a walk pivot 258.

The walk mechanism housing includes a walk plate 266, two vertical support columns 268, a walk servo plate 270, and a circular walk track 272. The walk plate is a rectangular base with beveled corners and four mounting holes for mounting to the carousel base unit 14. The walk servo plate 270 is a similar rectangular shape as the walk plate and it has rectangular slots located at its longitudinal ends. The walk servo plate also has a hole in its center for mounting the walk pivot 258. Above the walk servo plate is a circular walk track 272 with two parallel elongated slots positioned vertically above the longitudinal sides of the walk servo plate 270 and the slots extend from the outside of the circle to just over half-way into the circle.

Each lower end of the vertical support columns 268 are secured to the walk plate 266 at about the walk plate's longitudinal mid-point and adjacent to the longitudinal side of the rectangular walk plate. The upper ends of the columns 268 are secured to similar locations on the walk servo plate such that the columns support the walk servo plate 270. Multiple support columns 510 are mounted to an upper collar 506 of the carousel base unit 14 for supporting the walk track 272 of the walk mechanism. The walk track is fastened to the multiple support columns 510. (See also FIG. 1).

Since the walk mechanism is generally symmetric, one walk driver assembly 251, one walk bar assembly 252, one push rod 256, and a walk pivot 258 will be described. Each walk driver assembly includes a servo motor housing 276 enclosing a servo motor, a walk crank assembly 253, a walk track assembly 254, and three wires 262 carrying electrical signals corresponding to electrical power, ground and a pulse-width modulation signal.

The servo motor is enclosed in the servo housing 276. Preferably, the servo motor and related parts are similar to those parts described above in the cable driver assembly (see FIG. 3). The servo housing has a pair of flanges with mounting holes for attaching the servo motor housing to the vertical support column 268. Extending from the servo housing is a rotatable servo shaft that is actuated by the servo motor. The servo shaft has a splined exterior surface and a threaded bore. A servo plate having a central opening is mounted on the servo shaft and held in place by a fastener received through the central opening into the threaded bore of the servo shaft. The servo plate mounts on the servo shaft such that the servo plate rotates when the servo shaft rotates. The servo plate also has threaded holes for mounting the walk crank assembly 253.

The walk crank assembly 253 includes a conical servo lever 280, a servo rod 282 having threaded lower and upper ends, a sheath and swivel ball joint 284 for connecting onto the lower end of the servo rod, and a sheath and swivel ball joint 285 for connecting onto the upper end of the servo rod 282. The conical servo lever having a generally central opening 283 is mounted to the servo shaft and held in place by a fastener received through its central opening. The servo lever has holes 286 adjacent the central opening for mounting to the servo plate. The servo lever 280 also has a plurality of mounting holes extending from the central opening towards the apex of the conical servo lever 280 for mounting the servo rod 282. The plurality of mounting holes on the conical servo lever allows for radial adjustment of the connecting servo rod 282. Consistent with the overall modular design, the conical servo lever is similarly coupled to the servo motor as described above (FIG. 3) and described in the cable driver assembly section.

The sheath with the swivel ball joint 284 has a threaded bore for receiving the lower end of the threaded servo rod 282 and has a hole for mounting to the conical servo lever 280. This sheath and swivel ball joint 284 mounts with the use of a pin to one of the plurality of holes in the conical servo lever. A similar sheath and swivel ball joint 285 also has a threaded bore for receiving the upper end of the shaft. Also, the sheath and swivel ball joint 285 of the upper end of the shaft has a hole for mounting to the walk track assembly 254.

The walk track assembly 254 includes a vertical track 288 within the vertical support column 268, a walk slider 290, and a rod pivot 291. The vertical track and walk slider are within the vertical support member and is similar to the cable slider 42 and vertical track 46 of FIG. 3.

The walk slider 290 is a rectangular block with a plurality of holes 292 for attaching the walk slider to the walk crank assembly. The walk slider has flanges protruding outwardly extending along its lengthwise sides for being cooperatively received within the vertical track 288 (not shown). The walk slider 290 is similar to the cable slider 42 of the cable driver assembly described above (FIG. 3), and fits within a vertical track that allows the walk slider to vertically move in response to its associated servo motor. The hole that is at the top of the walk slider may be used for mounting the walk slider to the rod pivot 291, which connects the walk slider to the push rod 256. The rod pivot 291 provides a horizontal axis of rotation for the push rod. For ease in adjusting and servicing, the walk slider has different mounting holes for adjustably mounting the upper end of the servo rod 282.

The push rod 256 is an elongated rod having two ends. At its upper end the push rod has a sharp bend for connecting to a foot support 294 of the animated figure. The push rod's lower end is received by the rod pivot 291. In the preferred embodiment, once the associated servo motor of one of the walk driver assemblies is actuated by a pulse-width modulation signal, the walk crank assembly acts on the walk track assembly moving the push rod vertically and the vertical movement of the push rod moves the animated figure's foot support 294 in a vertical direction.

The walk bar assembly 252 of animated figure's walk mechanism 250 provides horizontal translation of the foot support 294. Each walk bar assembly mounted on the walk servo plate 270, includes a servo motor housing 312 enclosing a servo motor, a bar crank assembly 309, a walk bar 310, and a walk pivot 258.

The servo motor is enclosed in the servo housing 312. Preferably, the servo motor and related parts are similar to those parts described above in the cable driver assembly. The servo housing is received into one of the rectangular slots of the walk servo plate 270. Also the servo housing 312 has a pair of flanges with mounting holes for attaching the servo motor housing to the walk servo plate 270. Extending from the servo housing is a rotatable servo shaft that is actuated by the servo motor. Similar to the crank assembly 35 of the cable driver assembly described above (see FIG. 3), the bar crank assembly 309 preferably includes the same parts and interconnections as the crank assembly for the cable driver assembly. Thus, the bar crank assembly 309 includes an elliptical servo crank, a crank arm, a shaft having threaded lower and upper ends, a sheath and swivel ball joint for connecting onto the lower end of the shaft, and a sheath and swivel ball joint for connecting onto the upper end of the shaft. The difference being that the bar crank assembly connects via the sheath and swivel ball joint of the upper end of the shaft to the walk bar 310.

The walk bar 310 is an elongated elliptical member with an elongated elliptical slot 255. The walk bar has two ends. At one end, the walk bar has a hole for receiving and mounting to the walk pivot 258. The walk pivot pivots about a vertical axis and allows horizontal movement of the walk bar. The elliptical slot 255 of the walk bar 310 receives the push rod 256 and allows the push rod to pass through the walk bar. In the preferred embodiment, once the associated servo motor of one of the walk bar assemblies is actuated by a pulse-width modulation signal, the bar crank assembly 309 moves the walk bar 310 horizontally. Since the push rod 256 passes through the slot 255 in the walk bar 310, the horizontal movement of the walk bar moves the push rod 256 horizontally, thereby moving the animated figure's foot support 294 in a horizontal direction.

The walk mechanism 250, therefore, provides in combination both horizontal and vertical movement, of the animated figure's feet to achieve an important feature, such as simulating dancing steps, walking steps, or other stepping movements in a very realistic manner. Further, the walk mechanism in combination with a motion base 16 (described below) allows the animated figure of the preferred embodiment to move about on a horizontal plane, achieving another important feature in character animation. This feature, allows the animated figure of the preferred embodiment to move about a set, such as a stage, by dancing, walking, running or other movements, thereby increasing the overall animation presentation significantly.

KNEE JOINT ASSEMBLY

With reference to FIG. 8, the knee joint assembly 320 uses similar parts as other assemblies but in the preferred embodiment, movement of the knee joint assembly results from the walking mechanism 250 moving the animated figure's feet up and down. The knee joint assembly includes a thigh member 322, an upper leg clevis 324, a lower leg clevis 326, a lower leg 338, a tension spring 330 and a clevis pin 332. The upper leg clevis 324 and lower leg clevis 326, similar to the descriptions of the light weight clevis' above, are Y-shaped having an opening at its base and the other side of the clevis having holes in the ends through which a pin 332 is run. The thigh member 322 and lower leg 338 are tubular pieces having a top end and a bottom end. The upper leg clevis receives the bottom end of the thigh member in the opening at its base. Similarly, the lower leg clevis receives the top end of the lower leg in the opening at its base. Both use pins for securing the leg portion within the opening at the base of each clevis. The pin 332 is fastened through the holes in the ends of the upper leg clevis and through the holes in the ends of the lower leg clevis thereby rotatably attaching one clevis to the other via pin 332. Further, the upper leg clevis and lower leg clevis both have a lug 328 projecting from the clevis base providing a hole for hooking each end of the tension spring 330 to each clevis. A similar clevis is used for a foot support clevis 334 that receives the bottom end of the lower leg. The foot support clevis is connected to the foot support 294 (see FIG. 2). The foot support 294 (shown in FIG. 2) may be covered with some form of a shoe or other article depending upon the type of animated figure. Now with reference to FIGS. 2 and 8, the push rod 256 in response to the walk mechanism 250 moves the foot support which acts upon the animated figure's lower leg 338. Since the lower leg 338 is hinged to the thigh member 322 at pin 332, the knee assembly allows functions like a knee bending at the pin 332 and the tension spring maintains stability at the bending movement about the pin.

TORSO BEND ASSEMBLY

With reference to FIGS. 1 and 9, a torso bend assembly 340 includes a pelvis plate 342, a spine tension spring 344 with lower and upper ends, a belly plate 346, a chest plate 348 and the neck bushing 110 (FIG. 18). The pelvis plate 342 has a cavity 343 and a threaded bore 345 within the cavity. The lower end of the spine tension spring 344 is received in the cavity and held in place by a fastener received through the threaded bore. The pelvis plate also has a ferrule pathway 347 for receiving and restraining cable housing 56 and allowing the inner control cable 50 to extend therefrom. The belly plate 346 is oval shaped, having a plurality of cable routing holes 349, a cable hole 350, and a central opening 351. The central opening has a projecting rim around the opening with a threaded bore (not shown) in the side of the projecting rim. The plurality of cable routing holes are for receiving control cables 51 and guiding them towards their respective movement assemblies. The cable hole 350 allows the cable 50, from the torso's cable driver assembly, to extend through to the chest plate 348. The spine spring 344 extends through the central opening and is held in place by a fastener received through the threaded bore. The neck bushing 110, as shown in FIGS. 18, has a central hole 125 and a threaded bore radially entering the central hole for fastening the spring 344 to the neck bushing 110. That is, the spine spring extends into the central hole 125 and is held in place by a fastener received through the threaded bore. There are other mounting holes on the top surface of the neck bushing 110 (see FIG. 18) for mounting the chest plate 348 on the neck bushing. As shown in FIG. 18, the chest plate is rectangular with a rounded side, having a cable hole 352 extending through the plate, and a flange 355 projecting perpendicularly upward from the chest plate.

The cable hole 352 in the chest plate 348 receives the control cable 50 from the torso's cable driver assembly (See FIG. 3) and a tab 354 prevents the cable from being pulled downward through hole 352. In operation of the preferred embodiment, once the cable driver assembly corresponding to the torso bend assembly 340 pulls on the control cable 50, at a force greater than the spine spring's return force, the cable 50 retracts within the cable housing 56 pulling on the chest plate 348 causing the chest plate to move downward. As the chest plate moves downward the spine spring 344 bends giving the impression that the animated figure is bowing at the waist. Once the servo shaft corresponding to this cable driver assembly returns to its neutral position, and the control cable 50 is no longer being pulled downward, the spine tension spring 344 acts on the torso assembly to return the animated figure's torso to its neutral upright position. This is preferably accomplished, as with the other spring returns in this description, by having a tension spring with a spring rate that exceeds the rotation speed at the servo shaft, thereby keeping the cable in tension.

EYE SHIFT ASSEMBLY

Figure 15:
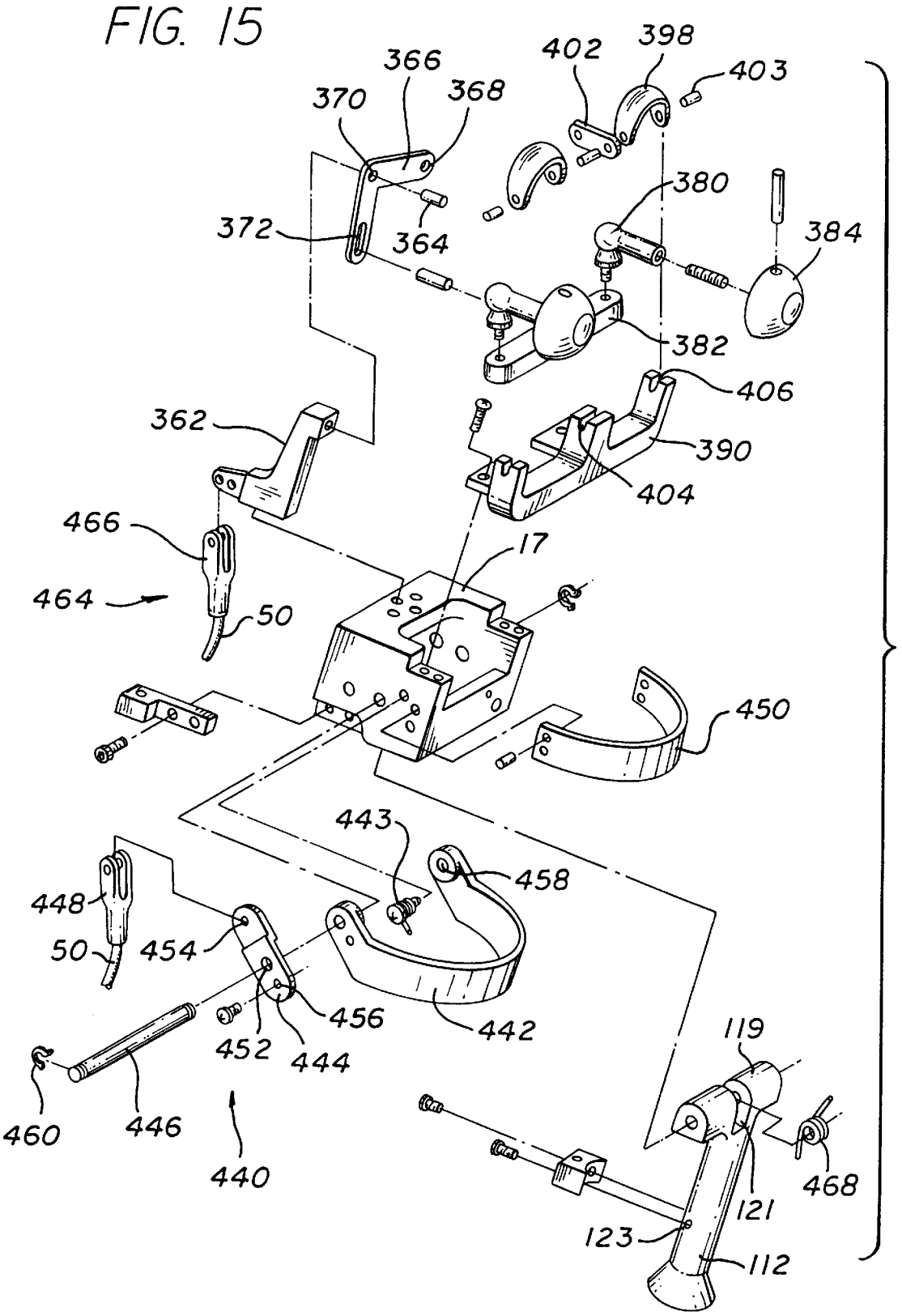
FIG. 15 is a perspective view with portions exploded, of a head assembly with relationship to an eye shift assembly, an eye lid assembly and mouth assembly used on the apparatus of FIG. 1.

With reference to FIGS. 1, 15 and 17, an eye shift assembly 360 causes eyes 384 of the animated figure to move side to side. The eye shift assembly includes a guide member 362, a lever arm 366, a clevis 374, two ball joint assemblies 380, connected to a toggle bar 382 and an eye support 390. The guide member is mounted on the head 17 of the animated figure (see FIG. 15) and is a flat, curved L-shaped with a protruding pin 364 at an upper end. The lever arm 366 has a flat L-shape with a central hole 370 at a central corner, a hole 368 at one end and a slot 372 at the lever arm's other end. The central hole 370 of the lever arm receives the pin 364 of the guide member 362. The clevis 374 is similar to other clevis' used in the preferred embodiment for receiving at a base end the control cable 50 and for fastening to the lever arm 366 at its other end by mounting pin 376 through the hole 368 in the lever arm. The toggle bar 382 has a elongated elliptical shape and includes a pin 381 and two ball joint assemblies mounted on opposite ends of the toggle bar. The ball joint assemblies 380 include two ball joints each mounted at one end to the toggle bar 382 and at the ball joints opposite end a short rod extends therefrom for connecting to an eye piece 384. The eye piece has a spherical shape and includes a hole at an upper portion for receiving a pin for fastening the eye piece to the eye support 390 through a hole 388 in the eye support. The eye support is fastened to the head 17 of the animated figure (FIG. 15). The toggle bar 382 has a pin 381 extending from the toggle bar and is received by the slot 372 in the lever arm. In operation of the preferred embodiment the slot 372 on the lever arm receives the pin 381 of the toggle bar so that as the toggle bar moves around the ball joint axis, binding of the control cable 50 is prevented. Once the cable driver assembly corresponding to the eye shift assembly 360 is actuated, the control cable is moved, either pushed or pulled, causing the lever arm to move about its central hole 370 causing the toggle bar to move generally in the horizontal direction because of the pin 381 connection to the slot 372 in the lever arm. As a result, the eye pieces 384 appear to shift from side to side as if the animated figure is looking in one direction or another. This is preferably accomplished with the slot 372 on the lever arm 366 for acting on the pin 381 of the toggle bar so that as the toggle bar moves back and forth about the ball joint axis the control cable 50 is prevented from binding.

EYE BLINK ASSEMBLY

With reference to FIGS. 1, 15 and 16, an eye blink assembly 396 causes eyelids 398 of the animated figure to cover and recede over the animated figure's eyes 384. In the preferred embodiment, the eye blink assembly includes two eyelids 398, a lid lever 402, a clevis 400, and the eye support 390. The eyelids have a spherical shape and between each eye lid is a pin connecting them. Also, the eyelids have a pin 403 extending radially outward for mounting within the animated figure's head assembly providing a rotational axis. The lid lever 402 receives the pin between the eyelids. The lid lever is also between the eyelids having a hole for receiving the clevis 400. Similar to many of the movement assemblies in the preferred embodiment, the clevis receives the control cable 50 for transferring the force from the cable to the movement assembly. The eye support 390 has a center recess 404 for snap fitting the pin between the eye lids to the eye support. The eye support also has recesses 406 at opposite ends for receiving the eye lids radially extending pins. In operation of the preferred embodiment, once the corresponding cable driver assembly pushes or pulls the control cable, the clevis 400 acts on the lid lever 402 causing the eye lids to move. This movement causes the eye lids to blink with respect to the animated figure's eyes.

CAROUSEL BASE UNIT

With reference to FIGS. 1 and 2 the carousel base unit 14 of the preferred apparatus is has a circular column shape for allowing the walk mechanism mount within the inner circular portion of the carousel base unit. Also a plurality of cable driver assemblies are mounted on the carousel base unit. The carousel base unit includes four circular collars, multiple support columns for connecting and supporting the four collars, and mounting holes for receiving the multiple support columns. The four collars include a base collar 500, a servo collar 502, a cable slider collar 504, and an upper collar 506. Mounting holes are provided within the cable slider collar for mounting the walk plate 266 of the walk mechanism to the carousel base unit.

The base collar has mounting holes around the periphery for receiving multiple support columns 508 for supporting the servo collar over the base collar. This allows for a space between the two collars allowing wires 24 to connect to the carousel base unit 14 with a standard ribbon cable connector (not shown), or other quick disconnect connector, allowing for easy disconnect of the wires 24. The servo housings 23 are mounted between the servo collar 502 and the cable slider collar 504. The track units 44 of each cable driver assembly 20 (FIG. 3) are mounted between the cable slider collar 504 and the upper collar 506. Preferably, both the servo housings and the tracks units 44 are peripherally mounted around the outer circular portions of their respective collars. This advantageously eases any servicing of the cable driver assemblies that are mounted within the carousel base unit 14. Also, the walk mechanism 250 is received within the openings of the upper collar. The walk plate 266 of the walk mechanism is mounted and fastened to the cable slider collar 504. Multiple support columns 510 are mounted to the upper collar 506 for supporting the walk track 272 of the walk mechanism. The cable conduit 60 is mounted to the carousel base unit 14.

The mounting of the walk mechanism within the carousel base unit advantageously allows for relatively quick and easy removal and insertion of the walk mechanism. This adds to the modular aspects of the overall animated figure apparatus. Also, if a particular animated figure does not require lower body movement, such as a bird flying, the walk mechanism can be quickly removed and used with an animated figure apparatus requiring lower body movement. In addition, in the preferred embodiment, many servo motors can be located within the carousel base unit and walk mechanism for applying force to various movement assemblies of the animated FIG. 12. Therefore, in a relatively small area a plurality of servo motors cause many movements by the animated figure. As a result, detailed control of many animated figure functions using intricate control cable branching can be accomplished.

MOTION BASE

Figure 6:
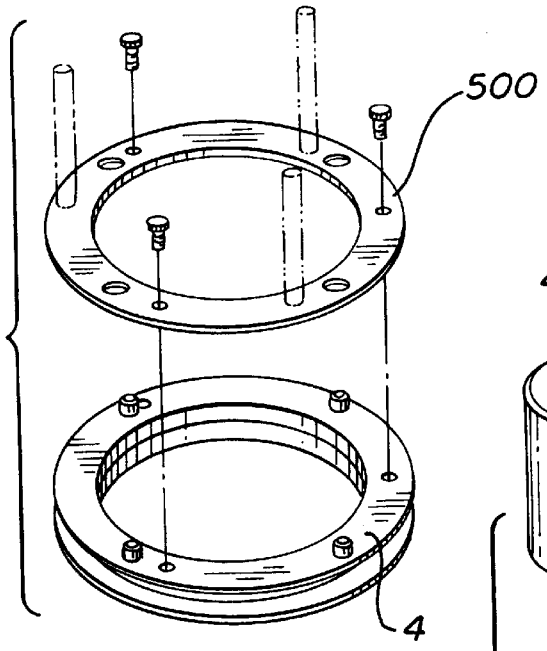
FIG. 6 is an exploded view of the relationship between the base collar of the carousel base unit and turntable and the mounting of the base collar to the turntable.
Figure 7:
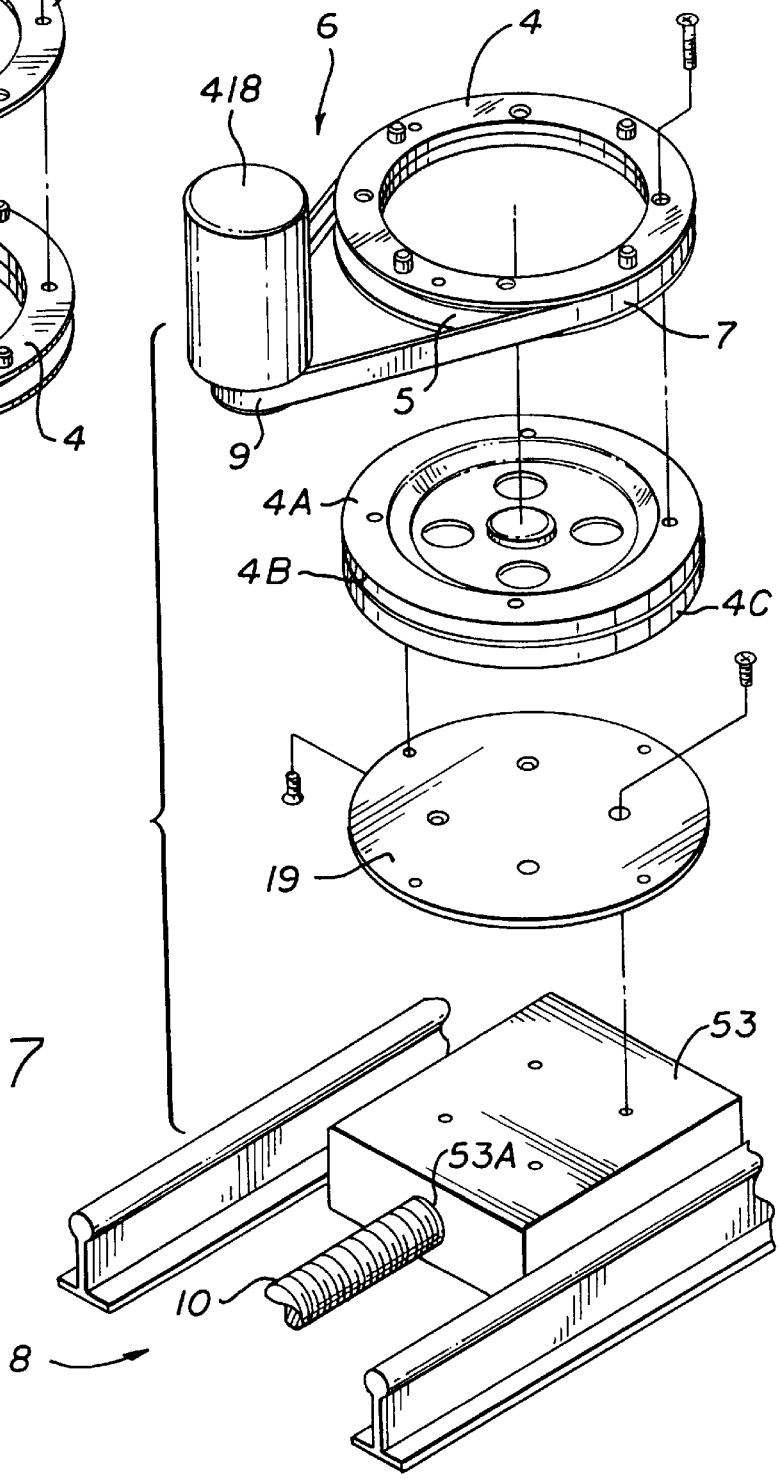
FIG. 7 is an exploded view of the relationship between the pulley assembly, turntable and linear actuator.

With reference to FIGS. 1, 6 and 7, the motion base 16 moves the animated figure linearly along an axis and rotationally about a vertical axis. The motion base includes a pulley assembly 6 having a turntable 4, and a linear actuator 8. The turntable includes a grooved rim 5 in which a belt 7 of the pulley assembly runs so as to turn the turntable. The turntable of the pulley assembly fastens to a turntable base 4A. The turntable base is circular and includes an upper portion 4B and lower portion 4C. Like a standard turntable, the upper portion of the turntable base is able to rotate while the lower portion 4C is fixed. The turntable base is mounted to a circular mount 19 which in turn is mounted to a block 53 of the linear actuator. The turntable 4 has various mounting holes around its edge for allowing the carousel base unit 14 to be fastened thereon. The base collar 500 of the carousel base unit is mounted and fastened to the turntable 4 (FIG. 6). This allows the carousel base unit to rotate in cooperation with turntable.

The pulley assembly includes a platform driver with a grooved rim 9 for receiving the belt 7. A pulley motor 418 is coupled to the controller 18 for receiving signals from the controller 18. The pulley motor 418 rotationally drives the platform driver with the grooved rim 9. The pulley motor preferably is a stepper motor and can receive signals from the controller 18 for controlling the platform driver 9.

The linear actuator 8 includes a track motor 416 (FIG. 1), which is preferably a stepper motor, for causing a threaded rod 10 within a linear track 10A to rotate. The threaded rod is received by a threaded hole 53A in the block 53 that is beneath the pulley assembly 6. The threaded rod is coupled to the track motor 416 and rotates in response to the linear actuator's track motor 416 causing the block 53 and mounted turntable 4 to move linearly along the threaded rod 10 and within the linear track 10A. The pulley assembly is mounted to the linear actuator such that the pulley assembly moves linearly with the block 53. Because the carousel base unit 14 is coupled to the turntable 4, it also moves linearly in cooperation with the block 53. The track motor 416 is coupled to the controller 18 that transmits signals for controlling the linear movement along the threaded rod axis. As described above the carousel base unit 14 is mounted onto the turntable 4 and the animated figure is supported by the base unit 14. Thus, the linear actuator 8 of the motion base 16 linearly moves the pulley assembly along the threaded rod and also the carousel base unit 14 and animated FIG. 12. In operation of the pulley assembly, the turntable 4 in cooperation with the pulley assembly 6 moves the carousel base unit 14 and animated FIG. 12 rotationally. Thus, the motion base 16 in combination with the walk mechanism 250 allows the animated figure to translate about a set by walking, stepping or dancing.

MOUTH ASSEMBLY

With reference to FIG. 15, a mouth assembly of the animated figure will be described. Similar to other movement assemblies within the animated figure apparatus, a mouth assembly acting in cooperation with its respective cable driver assembly causes a lower jaw of the animated figure to move. In an animation presentation this may appear as if the animated figure is talking or singing. In addition, the animated figure apparatus can be synchronized to audio giving the appearance that the animated figure is talking or singing.

The mouth assembly 440 includes a lower jaw 442, a torsion spring 443, mouth lever 444, a pin 446, a mouth clevis 448 and upper jaw 450. The lower and upper jaws are arch-shaped. The upper jaw is fastened to the head 17 of the animated figure. The lower jaw has a hole 458 at each end of its arch form. The mouth lever is oval shaped having a central opening 452, a clevis hole 454 and a mounting hole 456. The pin 446 is received through the central opening and extends through the first hole 458 of the lower jaw, through a pathway in the animated figure's head 17 and through the other hole 458 of the lower jaw arch form. The torsion spring 443 has two ends, one end is fastened to the head 17 and the other end of the torsion spring is mounted to the lower jaw 442. The lower jaw pivots about the pin 446 extending through the head 17. The mouth lever is fastened to the lower jaw through mounting hole 456. The mouth lever is also held in place with respect to the pin 446 by a C-clamp. The mouth clevis 448 is similar to others described above for receiving a control cable 50 at its base end and a pin at the other end of the clevis rotatably mounts the clevis to the mouth lever via clevis hole 454. Similar to other movement assemblies in this preferred embodiment, the movement of the lower jaw occurs when a force is applied on the control cable connected to the mouth clevis causing the lower jaw to move away from or towards its upper jaw. Similar to the other movement assemblies, the control cable corresponding to the mouth assembly is driven by a cable driver 20 mounted on the carousel base unit 14 (FIG. 1).

HEAD NOD ASSEMBLY

The head 17 of the animated figure is also moved in a similar manner to the other movement assemblies. With reference to FIG. 15, the head nod assembly 464 includes the guide member 362, described above (FIG. 17), the animated figure's head 17, a nod clevis 466 and a torsion spring 468. The torsion spring is mounted within the gap 121 of the animated figure's neck 112. The symmetrical flanges 119 of the neck are received by the animated figure's head 17 (not shown) and a pin 446 extends through the head, through the symmetrical flanges 119 and through a central opening in the torsion spring 468. The nod clevis receives the control cable 50. The nod clevis attaches to the guide member 362 which is mounted to the head 17. A head nod movement occurs when a force is applied to the control cable 50 causing the force to be translated to the guide member 362 which acts to move the head 17 of the animated figure about the pin 446. Of course the head 17 moves when the force generated by the head nod assembly's respective cable driver is greater than the return force of the torsion spring 468. As a result, in operation the head of the animated figure can be moved in an up and down motion to enhance the animated figure's presentation.

CONTROLLER

Figure 23:
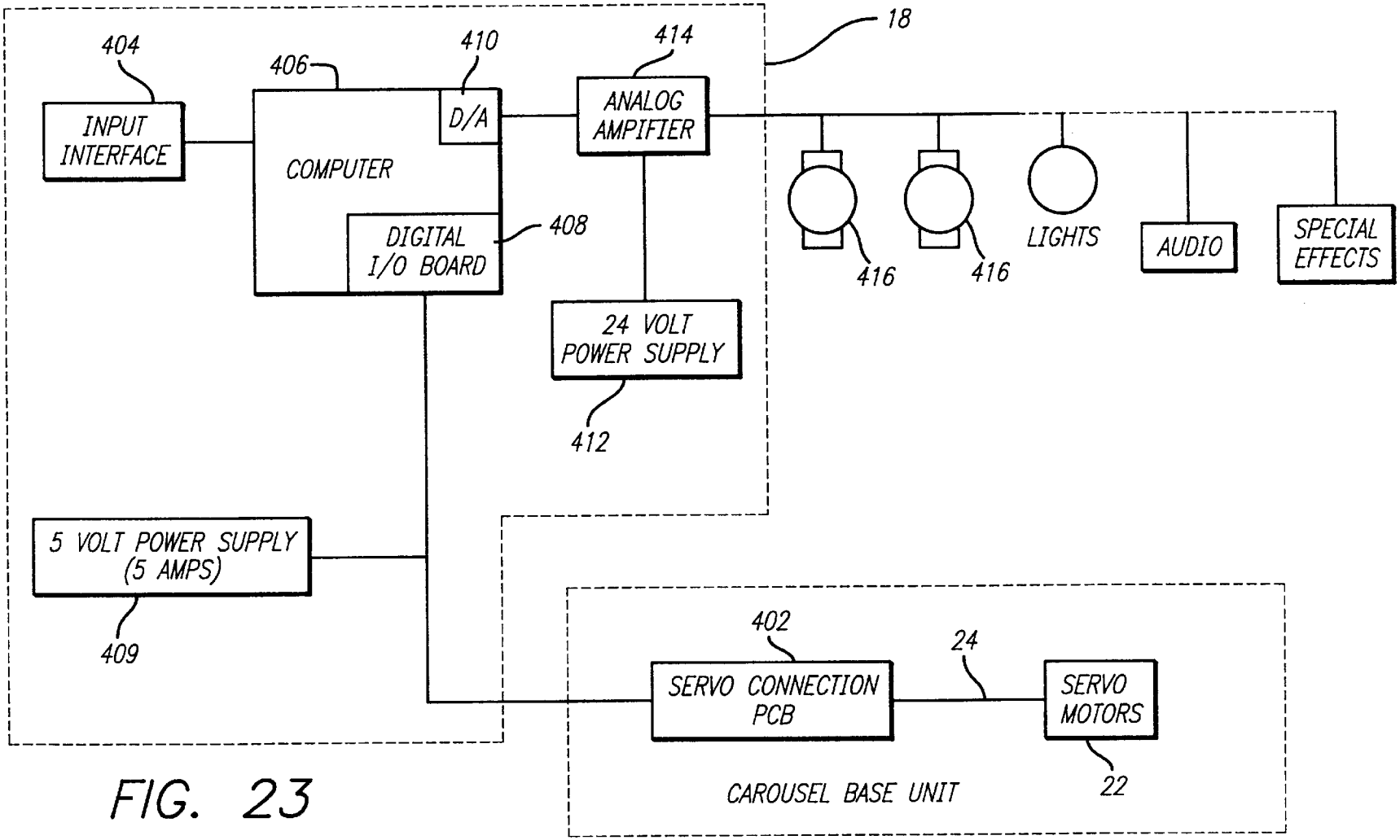
FIG. 23 is a block diagram of a controller.

A controller 18 may be used for supplying the necessary signals to the various servo motors on the carousel base unit 14, the walk mechanism 250, the track motor 416, the pulley motor 418 and lighting, audio, and special effects equipment. With reference to FIGS. 1 and 23, the controller 18 may include an input interface 404, a processor with storage capability 406, digital output board, such as a digital I/O board 408, a digital-to-analog converter 410, a low voltage power supply 409, a 24 volt unregulated power supply 412, and an analog signal amplifier 414. The input interface could be many different devices including a MIDI input device, fader box, or keyboard for providing input to the processor. The processor with storage capability could be a personal computer or a dedicated processor outputting signals corresponding to animation commands for causing the animated figure to move and also for controlling such things as the track motor 416, the pulley motor 418, lights, audio or other special effects. The digital I/O board is coupled to the various servo motors within the carousel base unit 14 and the walk mechanism 250 for providing signals from the processor to the various servo motors for controlling the movements of the animated figure as well as the walk mechanism 250 of the animated figure. The servo motors are also connected to the power supply 409 for receiving power. The digital-to-analog converter 410 converts signals from the processor to analog signals for controlling analog devices such as the track motor 416 and the pulley motor 418 that are connected to the D/A converter. Other analog signals from the D/A converter 410 may be used to control other analog devices such as lighting equipment, audio equipment and other special effects. An analog signal amplifier 414 coupled to the D/A converter 410 may be used to amplify the analog signals for proper signal matching corresponding connected analog devices, such as the track motor 416 or the pulley motor 418. The twenty-four volt power supply 412 is coupled to these analog devices for supplying power signals to the analog devices.

Three wires (shown in FIG. 1 as a multi-three wire ribbon cable) 24 for each servo motor provide power, ground and pulse-width modulated signals to each servo motor are directly connected at one end to the servo motor 22. The other end of these wires are coupled to the controller 18 for providing these signals. With reference to FIGS. 1 and 23, the wires for providing the signals to the plurality of cable driver assemblies are connected to a central distribution connector for connecting to a printed circuit board (PCB) 402, mounted at the lower end of the carousel base unit 14. The PCB passes the signals straight through to another connector for connecting wires to the controller's corresponding outputs. By using this PCB with connectors at both ends, the carousel base unit can quickly be disconnected and replaced with another carousel base unit without connecting and disconnecting many different wires. The connector from the controller is disconnected, the carousel base unit is removed, replaced with another carousel base unit 14, and the connector from the controller is connected to the new carousel base unit. This configuration provides for a quick and efficient change out of the entire animated figure.

The similarities in the overall control linkage of each of the animated figure's moveable element assemblies provide for consistent control in a similar manner over the various moveable elements and assemblies of the animated figure. Such an architecture allows for relatively easy preprogrammed pulse-width modulation signals that control the animated figure's cable and walk driver assemblies, walk bar assemblies and the analog signals for controlling the analog devices of the apparatus. Further, operation of the animated figure apparatus can be preprogrammed. With reference to FIGS. 1, 2 and 3, a computer based controller 18, such as a personal computer with digital output capability or a digital input/output board, sends electrical pulse-width modulated signals over the wires 24 connecting the controller 18 to each one of the servo motors 22 (or the similar servo motors of the walk mechanism 250). In response to the electrical signals from the controller, each servo shaft 26 rotates a number of degrees causing the servo crank arm 30 to rotate accordingly, thereby exerting force via the shaft 36 to the cable slider 42. Because the cable slider slides only vertically within the track 46, the rotary motion from the servo motor 22 is translated into a linear motion. This linear motion acts to either push or pull the associated control cable 50 (or associated rod of the walk mechanism). As described above, the other end of the control cable acts in conjunction with its corresponding movement assembly (e.g., elbow joint assembly) thereby moving one of the animated figure's moveable elements. Similar signals are transmitted to assemblies for controlling the walk mechanism 250 for achieving similar movements.

In operation, a further advantage to the present invention is that each one of the animated figure's servo motors 22 may independently receive signals from the controller 18, thus, translating these signals into independent animated figure movements. By sending predetermined signals to the various servo motors in a predetermined manner, the animated figure can be controlled to perform various routines. In addition, having storage capability in the computer based controller allows these predetermined signals to be stored in a predetermined manner for later retrieval and animated figure animation. In addition, the present invention achieves control of many animated figure functions using elaborate control cable branching which may require many bends in the control cable.

The present invention should not be seen as limited to the particular embodiment described above, but encompasses all variations, modifications, and equivalents within the scope of the following claims.

What is claimed is:

1. An animated figure apparatus comprising:

an animated figure having a moveable element;

a base unit for supporting the animated figure;

a cable driver mounted to the base unit at a location spaced from the animated figure;

said cable driver including a cable slider connected to a servo motor for providing a force on the cable slider, said cable slider being capable of moving with respect to the servo motor in a back and forth sliding motion and having a first position and a second position; and a control cable, said control cable having a first end operably connected to said cable slider and said control cable having a second end secured to said moveable element, said moveable element located in a first position when the cable slider is in said first position and said moveable element located in a different position when the cable slider is in said second position.

2. An animated figure apparatus comprising:

an animated figure having a plurality of moveable elements;

a base unit for supporting the animated figure;

a plurality of cable drivers mounted to the base unit at locations spaced from the animated figure;

each of said cable drivers including a cable slider connected to a servo motor for providing a force on the cable slider, said cable slider being capable of moving with respect to the servo motor in a back and forth sliding motion and having a first position and a second position; and a plurality of control cables, each of said plurality of control cables having a first end operably connected to a corresponding one of said plurality of cable sliders and each of said plurality of control cables having a second end secured to a corresponding one of said plurality of moveable elements, said plurality of moveable elements located in a first position when the corresponding cable slider is in said first position and said plurality of moveable elements located in a different position when the corresponding cable slider is in said second position.

3. An animated figure apparatus of claim 2, wherein at least one control cable passes through a ferrule pathway.

4. An animated figure apparatus of claim 2, wherein said base unit for supporting said animated figure is a carousel base unit located below said animated figure.

5. An animated figure apparatus of claim 2 further comprising:

a rotatable platform, said base unit removably attached to said platform, and a platform driver for rotating said platform, whereby as the platform is rotated, the base unit in conjunction with said animated figure is rotated.

6. An animated figure apparatus of claim 5 further comprising a linear actuator coupled to the animated figure for providing translation of said animated figure.

7. An animated figure apparatus of claim 2, further comprising a plurality of cable housings each having a low friction pathway, wherein at least one of said plurality of control cables is a low friction control cable and wherein said at least one control cable is fed from said corresponding one of said cable drivers to said corresponding one of said moveable elements through a corresponding said low friction pathway within said cable housing, said cable housing having a plurality of bends.

8. An animated figure apparatus of claim 2, wherein at least one of said plurality of control cables has a plurality of bends.

9. An animated figure apparatus comprising:

an animated figure having a plurality of moveable elements;

a base unit for supporting the animated figure;

a plurality of cable drivers mounted to the base unit at locations spaced from the animated figure, each of said cable drivers including a cable slider connected to a servo motor for providing a force on the cable slider, said cable slider being capable of moving with respect to the servo motor in a back and forth sliding motion and having a first position and a second position; and a plurality of control cables, each of said plurality of control cables having a first end operably connected to a corresponding one of said plurality of cable drivers and each of said plurality of control cables having a second end secured to a corresponding one of said plurality of moveable elements, said plurality of moveable elements located in a first position when the corresponding cable driver is in said first position and said plurality of moveable elements located in a different position when the corresponding cable driver is in said second position;

wherein said plurality of cable drivers are peripherally mounted on said base unit for ease in adjusting the cable drivers.

10. An animated figure apparatus of claim 9, further comprising a support conduit carried by said base unit for supporting said animated figure, said multiple control cables threaded through said support conduit from the peripherally mounted cable drivers to the animated figure.

11. An animated figure apparatus of claim 10, wherein said support conduit for supporting said animated figure extends below said animated figure.

12. An animated figure apparatus comprising:

an animated figure having a plurality of moveable elements;

a base unit for supporting the animated figure;

a plurality of cable drivers mounted to the base unit at locations spaced from the animated figure, each of said cable drivers having a first position and a second position; and a plurality of control cables, each of said plurality of control cables having a first end operably connected to a corresponding one of said plurality of cable drivers and each of said plurality of control cables having a second end secured to a corresponding one of said plurality of moveable elements, said plurality of moveable elements located in a first position when the corresponding cable driver is in said first position and said plurality of moveable elements located in a different position when the corresponding cable driver is in said second position;

wherein each of said plurality of cable drivers includes a cable slider connected to the first end of a corresponding one of said plurality of control cables;

a shaft having an upper end mounted to said cable slider and said shaft having a lower end; and a servo motor having a rotatable spindle operably connected to the lower end of said shaft, causing a force to be exerted on said shaft thereby moving the cable slider upon rotation of the spindle.

13. An animated figure apparatus comprising:

an animated figure having a plurality of moveable elements;

a base unit for supporting the animated figure;

a plurality of cable drivers mounted to the base unit at locations spaced from the animated figure, each of said cable drivers having a first position and a second position; and a plurality of control cables, each of said plurality of control cables having a first end operably connected to a corresponding one of said plurality of cable drivers and each of said plurality of control cables having a second end secured to a corresponding one of said plurality of moveable elements, said plurality of moveable elements located in a first position when the corresponding cable driver is in said first position and said plurality of moveable elements located in a different position when the corresponding cable driver is in said second position;

wherein each of said plurality of cable drivers includes a track assembly connected to the first end of the corresponding one of said plurality of control cables;

a crank assembly connected to the track assembly; and a servo motor for providing a force on the crank assembly.

14. An animated figure apparatus comprising:

an animated figure having a plurality of moveable elements;

a base unit for supporting the animated figure;

at least one control cable;

at least one cable driver spaced from the animated figure, said at least one cable driver attached to the base unit whereby said cable driver renders a force on the at least one control cable;

said at least one control cable having a first end operably connected to a corresponding said at least one cable driver for pulling said control cable and said at least one control cable having a second end fixedly secured to a corresponding one of said plurality of moveable elements for moving one of said moveable elements; and said at least one cable driver includes:

a cable slider connected to the first end of one of said control cables, a shaft having an upper end rotatably mounted to said cable slider for moving said cable slider, a servo motor for driving an operatively connected servo lever arm, and said servo lever arm operably connected to a lower end of said shaft, said servo lever arm exerts a force on said shaft, whereby said servo motor forces said shaft to move said cable slider.

15. An animated figure apparatus of claim 14, wherein said shaft is adjustable.

16. An animated figure apparatus comprising:

an animated figure having a plurality of movement assemblies having a plurality of springs;

a plurality of servo motors;

a plurality of control cables having two ends, each control cable having a first end connected to a corresponding one of said plurality of servo motors remote from the animated figure and each of said plurality of control cables having a second end secured to a corresponding one of said plurality of movement assemblies for moving a moveable element; and a ferrule pathway within the animated figure and located between at least one of said plurality of control cables first end and second end.

* * * * *